US010221653B2

(12) United States Patent
Walton et al.

(10) Patent No.: US 10,221,653 B2
(45) Date of Patent: Mar. 5, 2019

(54) METHOD AND APPARATUS FOR MAGNETIC PULSE SIGNATURE ACTUATION

(71) Applicant: Halliburton Energy Services, Inc., Houston, TX (US)

(72) Inventors: Zachary W. Walton, Coppell, TX (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 15/411,180

(22) Filed: Jan. 20, 2017

(65) Prior Publication Data

US 2017/0130558 A1 May 11, 2017

Related U.S. Application Data

(62) Division of application No. 13/781,093, filed on Feb. 28, 2013, now Pat. No. 9,587,486.

(51) Int. Cl.
*E21B 47/12* (2012.01)
*E21B 34/06* (2006.01)
(Continued)

(52) U.S. Cl.
CPC ..... *E21B 34/066* (2013.01); *E21B 34/06* (2013.01); *E21B 34/14* (2013.01); *E21B 47/12* (2013.01);
(Continued)

(58) Field of Classification Search
CPC ..... E21B 47/122; E21B 34/06; E21B 34/066; E21B 34/14; G01V 3/26; G01V 11/002
See application file for complete search history.

(56) References Cited

U.S. PATENT DOCUMENTS 507,494 A 10/1893 Grotz
547,601 A 10/1895 Everitt
(Continued)

FOREIGN PATENT DOCUMENTS

EP 1609947 A1 12/2005
EP 2484862 A2 8/2012
(Continued)

OTHER PUBLICATIONS

Examination Report issued in related Australian patent application No. 2014221340, dated Feb. 11, 2016 (3 pages).
(Continued)

*Primary Examiner* — Cathleen R Hutchins
(74) *Attorney, Agent, or Firm* — John Wustenburg; Baker Botts L.L.P.

(57) ABSTRACT

A wellbore servicing tool comprising a housing comprising one or more ports and generally defining a flow passage, an actuator disposed within the housing, a magnetic signature system (MSS) comprising a magnetic sensor in signal communication with an electronic circuit disposed within the housing and coupled to the actuator, and a sleeve slidably positioned within the housing and transitional from a first position to a second position, wherein, the sleeve is allowed to transition from the first position to the second position upon actuation of the actuator, and wherein the actuator is actuated upon recognition of a predetermined quantity of predetermined magnetic pulse signatures via the MSS.

19 Claims, 18 Drawing Sheets

(51) Int. Cl.
*E21B 34/14* (2006.01)
*E21B 43/26* (2006.01)
*E21B 34/00* (2006.01)

(52) U.S. Cl.
CPC ..... *E21B 47/122* (2013.01); *E21B 43/26* (2013.01); *E21B 2034/007* (2013.01)

(56) References Cited

U.S. PATENT DOCUMENTS 2,076,308 A 4/1937 Wells
2,189,936 A 2/1940 Brandfon
2,189,937 A 2/1940 Broyles
2,308,004 A 1/1943 Hart
2,330,265 A 9/1943 Burt
2,373,006 A 4/1945 Baker
2,381,929 A 8/1945 Schlumberger
2,618,340 A 11/1952 Lynd
2,618,343 A 11/1952 Conrad
2,637,402 A 5/1953 Baker et al.
2,640,547 A 6/1953 Baker et al.
2,695,064 A 11/1954 Ragan et al.
2,715,444 A 8/1955 Fewel
2,871,946 A 2/1959 Bigelow
2,918,125 A 12/1959 Sweetman
2,961,045 A 11/1960 Stogner et al.
2,974,727 A 3/1961 Goodwin
3,029,873 A 4/1962 Hanes
3,055,430 A 9/1962 Campbell
3,122,728 A 2/1964 Lindberg, Jr.
3,160,209 A 12/1964 Bonner
3,195,637 A 7/1965 Wayte
RE25,846 E 8/1965 Campbell
3,217,804 A 11/1965 Peter
3,233,674 A 2/1966 Leutwyler
3,266,575 A 8/1966 Owen
3,398,803 A 8/1968 Leutwyler et al.
3,556,211 A 1/1971 Bohn et al.
3,659,648 A 5/1972 Cobbs
4,085,590 A 4/1978 Powell et al.
4,282,931 A 8/1981 Golben
4,352,397 A 10/1982 Christopher
4,377,209 A 3/1983 Golben
4,385,494 A 5/1983 Golben
4,402,187 A 9/1983 Golben et al.
4,598,769 A 7/1986 Robertson
4,796,699 A 1/1989 Upchurch
4,856,595 A 8/1989 Upchurch
4,884,953 A 12/1989 Golben
5,024,270 A 6/1991 Bostick
5,040,602 A 8/1991 Helms
5,058,674 A 10/1991 Schultz et al.
5,089,069 A 2/1992 Ramaswamy et al.
5,101,907 A 4/1992 Schultz et al.
5,117,548 A 6/1992 Griffith et al.
5,155,471 A 10/1992 Ellis et al.
5,163,521 A 11/1992 Pustanyk et al.
5,188,183 A 2/1993 Hopmann et al.
5,197,758 A 3/1993 Lund et al.
5,211,224 A 5/1993 Bouldin
5,238,070 A 8/1993 Schultz et al.
5,279,321 A 1/1994 Krimm
5,316,081 A 5/1994 Baski et al.
5,316,087 A 5/1994 Manke et al.
5,355,960 A 10/1994 Schultz et al.
5,396,951 A 3/1995 Ross
5,452,763 A 9/1995 Owen
5,485,884 A 1/1996 Hanley et al.
5,490,564 A 2/1996 Schultz et al.
5,531,845 A 7/1996 Flanigan et al.
5,558,153 A 9/1996 Holcombe et al.
5,573,307 A 11/1996 Wilkinson et al.
5,575,331 A 11/1996 Terrell
5,622,211 A 4/1997 Martin et al.
5,662,166 A 9/1997 Shammai
5,673,556 A 10/1997 Goldben et al.
5,687,791 A 11/1997 Beck et al.
5,700,974 A 12/1997 Taylor
5,725,699 A 3/1998 Hinshaw et al.
6,128,904 A 10/2000 Rosso, Jr. et al.
6,137,747 A 10/2000 Shah et al.
6,172,614 B1 1/2001 Robison et al.
6,186,226 B1 2/2001 Robertson
6,196,584 B1 3/2001 Shirk et al.
6,315,043 B1 11/2001 Farrant et al.
6,333,699 B1 12/2001 Zierolf
6,364,037 B1 4/2002 Brunnert et al.
6,378,611 B1 4/2002 Helderle
6,382,234 B1 5/2002 Birckhead et al.
6,438,070 B1 8/2002 Birchak et al.
6,450,258 B2 9/2002 Green et al.
6,450,263 B1 9/2002 Schwendemann
6,470,996 B1 10/2002 Kyle et al.
6,536,524 B1 3/2003 Snider
6,561,479 B1 5/2003 Eldridge
6,568,470 B2 5/2003 Goodson, Jr. et al.
6,583,729 B1 6/2003 Gardner et al.
6,584,911 B2 7/2003 Bergerson et al.
6,598,679 B2 7/2003 Robertson
6,619,388 B2 9/2003 Dietz et al.
6,651,747 B2 11/2003 Chen et al.
6,668,937 B1 12/2003 Murray
6,672,382 B2 1/2004 Schultz et al.
6,695,061 B2 2/2004 Fripp et al.
6,705,425 B2 3/2004 West
6,717,283 B2 4/2004 Skinner et al.
6,776,255 B2 8/2004 West et al.
6,848,503 B2 2/2005 Schultz et al.
6,880,634 B2 4/2005 Gardner et al.
6,915,848 B2 7/2005 Thomeer et al.
6,925,937 B2 8/2005 Robertson
6,971,449 B1 12/2005 Robertson
6,973,993 B2 12/2005 West et al.
6,998,999 B2 2/2006 Fripp et al.
7,012,545 B2 3/2006 Skinner et al.
7,063,146 B2 6/2006 Schultz et al.
7,063,148 B2 6/2006 Jabusch
7,068,183 B2 6/2006 Shah et al.
7,082,078 B2 7/2006 Fripp et al.
7,083,009 B2 8/2006 Paluch et al.
7,104,276 B2 9/2006 Einhaus
7,152,657 B2 12/2006 Bosma et al.
7,152,679 B2 12/2006 Simpson
7,165,608 B2 1/2007 Schultz et al.
7,191,672 B2 3/2007 Ringgenberg et al.
7,195,067 B2 3/2007 Manke et al.
7,197,923 B1 4/2007 Wright et al.
7,199,480 B2 4/2007 Fripp et al.
7,201,230 B2 4/2007 Schultz et al.
7,210,555 B2 5/2007 Shah et al.
7,234,519 B2 6/2007 Fripp et al.
7,237,616 B2 7/2007 Patel
7,246,659 B2 7/2007 Fripp et al.
7,246,660 B2 7/2007 Fripp et al.
7,252,152 B2 8/2007 LoGiudice et al.
7,258,169 B2 8/2007 Fripp et al.
7,301,472 B2 11/2007 Kyle et al.
7,301,473 B2 11/2007 Shah et al.
7,322,416 B2 1/2008 Burris, II et al.
7,325,605 B2 2/2008 Fripp et al.
7,337,852 B2 3/2008 Manke et al.
7,339,494 B2 3/2008 Shah et al.
7,363,967 B2 4/2008 Burris, II et al.
7,367,394 B2 5/2008 Villareal et al.
7,372,263 B2 5/2008 Edwards
7,373,944 B2 5/2008 Smith et al.
7,387,165 B2 6/2008 Lopez de Cardenas et al.
7,395,882 B2 7/2008 Oldham et al.
7,398,996 B2 7/2008 Saito et al.
7,404,416 B2 7/2008 Schultz et al.
7,428,922 B2 9/2008 Fripp et al.
7,431,335 B2 10/2008 Khandhadia et al.
7,472,589 B2 1/2009 Irani et al.
7,472,752 B2 1/2009 Rogers et al.
7,508,734 B2 3/2009 Fink et al.

(56) References Cited

U.S. PATENT DOCUMENTS 7,510,017 B2 3/2009 Howell et al.
7,557,492 B2 7/2009 Fripp et al.
7,559,363 B2 7/2009 Howell et al.
7,559,373 B2 7/2009 Jackson et al.
7,595,737 B2 9/2009 Fink
7,596,995 B2 10/2009 Irani et al.
7,604,062 B2 10/2009 Murray
7,610,964 B2 11/2009 Cox
7,617,871 B2 11/2009 Surjaatmadja et al.
7,624,792 B2 12/2009 Wright et al.
7,640,965 B2 1/2010 Bosma et al.
7,665,355 B2 2/2010 Zhang et al.
7,669,661 B2 3/2010 Johnson
7,673,506 B2 3/2010 Irani et al.
7,673,673 B2 3/2010 Surjaatmadja et al.
7,699,101 B2 4/2010 Fripp et al.
7,699,102 B2 4/2010 Storm et al.
7,712,527 B2 5/2010 Roddy
7,717,167 B2 5/2010 Storm et al.
7,730,954 B2 6/2010 Schultz et al.
7,777,645 B2 8/2010 Shah et al.
7,781,939 B2 8/2010 Fripp et al.
7,802,627 B2 9/2010 Hofman et al.
7,804,172 B2 9/2010 Schultz et al.
7,832,474 B2 11/2010 Nguy
7,836,952 B2 11/2010 Fripp
7,856,872 B2 12/2010 Irani et al.
7,878,255 B2 2/2011 Howell et al.
7,946,166 B2 5/2011 Irani et al.
7,946,340 B2 5/2011 Surjaatmadja et al.
7,963,331 B2 6/2011 Surjaatmadja et al.
7,987,914 B2 8/2011 Benton
8,040,249 B2 10/2011 Shah et al.
8,091,637 B2 1/2012 Fripp
8,118,098 B2 2/2012 Hromas et al.
8,140,010 B2 3/2012 Symons et al.
8,146,673 B2 4/2012 Howell et al.
8,162,050 B2 4/2012 Roddy et al.
8,191,627 B2 6/2012 Hamid et al.
8,196,515 B2 6/2012 Streibich et al.
8,196,653 B2 6/2012 Fripp et al.
8,215,404 B2 7/2012 Makowiecki et al.
8,220,545 B2 7/2012 Storm, Jr. et al.
8,225,014 B2 7/2012 Kuhl
8,235,103 B2 8/2012 Wright et al.
8,235,128 B2 8/2012 Dykstra et al.
8,240,384 B2 8/2012 Miller et al.
8,261,839 B2 9/2012 Fripp et al.
8,276,669 B2 10/2012 Dykstra et al.
8,276,675 B2 10/2012 Williamson et al.
8,284,075 B2 10/2012 Fincher et al.
8,297,367 B2 10/2012 Chen et al.
8,302,681 B2 11/2012 Fripp et al.
8,319,657 B2 11/2012 Godager
8,322,426 B2 12/2012 Wright et al.
8,327,885 B2 12/2012 Dykstra et al.
8,356,668 B2 1/2013 Dykstra et al.
8,376,047 B2 2/2013 Dykstra et al.
8,397,803 B2 3/2013 Crabb et al.
8,459,377 B2 6/2013 Moyes
8,472,282 B2 6/2013 Fink et al.
8,474,533 B2 7/2013 Miller et al.
8,479,831 B2 7/2013 Dykstra et al.
8,505,639 B2 8/2013 Robison et al.
8,517,113 B2 8/2013 Sheffield
8,544,564 B2 10/2013 Moore et al.
2004/0156264 A1* 8/2004 Gardner ..... E21B 47/122 367/81
2004/0227509 A1 11/2004 Ucan
2005/0189945 A1 9/2005 Reiderman
2005/0241835 A1 11/2005 Burris, II et al.
2005/0260468 A1 11/2005 Fripp et al.
2005/0269083 A1 12/2005 Burris, II et al.
2006/0118303 A1 6/2006 Schultz et al.
2006/0144590 A1 7/2006 Lopez de Cardenas et al.
2007/0189452 A1 8/2007 Johnson et al.
2007/0204995 A1 9/2007 Hofman et al.
2007/0235199 A1 10/2007 Logiudice et al.
2008/0135248 A1 6/2008 Talley et al.
2008/0137481 A1 6/2008 Shah et al.
2008/0202766 A1 8/2008 Howell et al.
2009/0192731 A1 7/2009 De Jesus et al.
2009/0308588 A1 12/2009 Howell et al.
2010/0065125 A1 3/2010 Telfer
2010/0084060 A1 4/2010 Hinshaw et al.
2010/0201352 A1 8/2010 Englert
2011/0042092 A1 2/2011 Fripp et al.
2011/0079386 A1 4/2011 Fripp et al.
2011/0139445 A1 6/2011 Fripp et al.
2011/0168390 A1 7/2011 Fripp et al.
2011/0174484 A1 7/2011 Wright et al.
2011/0174504 A1 7/2011 Wright et al.
2011/0199859 A1 8/2011 Fink et al.
2011/0214853 A1 9/2011 Robichaux et al.
2011/0240301 A1 10/2011 Robison et al.
2011/0253383 A1 10/2011 Porter et al.
2011/0266001 A1 11/2011 Dykstra et al.
2011/0308806 A9 12/2011 Dykstra et al.
2012/0018167 A1 1/2012 Konopozynski et al.
2012/0048531 A1 3/2012 Marzouk et al.
2012/0075113 A1 3/2012 Loi et al.
2012/0111577 A1 5/2012 Dykstra et al.
2012/0138304 A1 6/2012 Dykstra et al.
2012/0146805 A1 6/2012 Vick, Jr. et al.
2012/0152527 A1 6/2012 Dykstra et al.
2012/0179428 A1 7/2012 Dykstra et al.
2012/0186819 A1 7/2012 Dagenais et al.
2012/0205120 A1 8/2012 Howell
2012/0205121 A1 8/2012 Porter et al.
2012/0211243 A1 8/2012 Dykstra et al.
2012/0234557 A1 9/2012 Dykstra et al.
2012/0241143 A1 9/2012 Wright et al.
2012/0255739 A1 10/2012 Fripp et al.
2012/0255740 A1 10/2012 Fripp et al.
2012/0279593 A1 11/2012 Fripp et al.
2012/0313790 A1 12/2012 Heijnen et al.
2012/0318511 A1 12/2012 Dykstra et al.
2012/0318526 A1 12/2012 Dykstra et al.
2012/0323378 A1 12/2012 Dykstra et al.
2013/0000922 A1 1/2013 Skinner et al.
2013/0014940 A1 1/2013 Fripp et al.
2013/0014941 A1 1/2013 Tips et al.
2013/0014955 A1 1/2013 Fripp et al.
2013/0014959 A1 1/2013 Tips et al.
2013/0020090 A1 1/2013 Fripp et al.
2013/0048290 A1 2/2013 Howell et al.
2013/0048291 A1 2/2013 Merron et al.
2013/0048298 A1 2/2013 Merron et al.
2013/0048299 A1 2/2013 Fripp et al.
2013/0048301 A1 2/2013 Gano et al.
2013/0075107 A1 3/2013 Dykstra et al.
2013/0092381 A1 4/2013 Dykstra et al.
2013/0092382 A1 4/2013 Dykstra et al.
2013/0092392 A1 4/2013 Dykstra et al.
2013/0092393 A1 4/2013 Dykstra et al.
2013/0098614 A1 4/2013 Dagenais et al.
2013/0106366 A1 5/2013 Fripp et al.
2013/0112423 A1 5/2013 Dykstra et al.
2013/0112424 A1 5/2013 Dykstra et al.
2013/0112425 A1 5/2013 Dykstra et al.
2013/0122296 A1 5/2013 Rose et al.
2013/0140038 A1 6/2013 Fripp et al.
2013/0153238 A1 6/2013 Fripp et al.
2013/0180727 A1 7/2013 Dykstra et al.
2013/0180732 A1 7/2013 Acosta et al.
2013/0186634 A1 7/2013 Fripp et al.
2013/0192829 A1 8/2013 Fadul et al.

FOREIGN PATENT DOCUMENTS

WO 9925070 A2 5/1999
WO 0220942 A1 3/2002
WO 2004018833 A1 3/2004
WO 2004099564 A2 11/2004

(56) References Cited

FOREIGN PATENT DOCUMENTS

| | | | |
|---|---|---|---|
| WO | 2006051250 | A1 | 5/2006 |
| WO | 2010002270 | A2 | 1/2010 |
| WO | 2010111076 | A2 | 9/2010 |
| WO | 2011021053 | A2 | 2/2011 |
| WO | 2011087721 | A1 | 2/2011 |
| WO | 2012078204 | A1 | 6/2012 |
| WO | 2012082248 | A1 | 6/2012 |
| WO | 2013032687 | A2 | 3/2013 |
| WO | 2013032687 | A3 | 3/2013 |
| WO | 2014092836 | A1 | 6/2014 |

OTHER PUBLICATIONS

International Search Report and Written Opinion issued in related PCT application No. PCT/US2014/015606, dated Jan. 7, 2015 (14 pages).
International Preliminary Report on Patentability issued in related PCT Application No. PCT/US2014/015606 , dated Sep. 11, 2015 (9 pages).
N. Vlajic: "Analog and Digital Signals, Time and Frequency—Representation of Signals", Dec. 20, 2010 (Dec. 20, 2010), XPO55150147, retrieved from the Internet: URL: http://www.eecs_yorku.ca/course_archive/2010-11/F/3213/CSE3213_04_AnalogDigitalSignals_F2010.pdf pp. 3, 7, 13, 20, 27.
Office Action dated Sep. 19, 2013 (17 pages), U.S. Appl. No. 12/688,058, filed Jan. 15, 2010.
Advisory Action dated Jul. 1, 2014 (3 pages), U.S. Appl. No. 12/688,058, filed Jan. 15, 2010.
Notice of Allowance dated Jul. 15, 2014 (28 pages), U.S. Appl. No. 12/688,058, filed Jan. 15, 2010.
Office Action (Final) dated Mar. 10, 2014 (13 pages), U.S. Appl. No. 12/688,058, filed Jan. 15, 2010.
Office Action dated Dec. 24, 2012 (9 pages), U.S. Appl. No. 12/688,058, filed Jan. 15, 2010.
Office Action dated Dec. 23, 2011 (8 pages), U.S. Appl. No. 12/688,058, filed Jan. 15, 2010.
Office Action dated Dec. 22, 2011 (8 pages), U.S. Appl. No. 12/965,859, filed Dec. 11, 2010.
Office Action (Final) dated May 9, 2014 (16 pages), U.S. Appl. No. 12/965,859, filed Dec. 11, 2010.
Office Action dated Sep. 19, 2013 (30 pages), U.S. Appl. No. 12/965,859, filed Dec. 11, 2010.
Office Action dated Dec. 3, 2013 (46 pages), U.S. Appl. No. 13/905,859, filed May 30, 2013.
Office Action (Final) dated Jul. 22, 2014 (21 pages), U.S. Appl. No. 13/905,859, filed May 30, 2013.
Filing receipt and specification for patent application entitled "Gas Generator for Pressurizing Downhole Samples," by Scott L. Miller, et al., filed May 30, 2013 as U.S. Appl. No. 13/905,859.
Foreign communication from a related counterpart application—International Search Report and Written Opinion, PCT/US2013/061386, dated Apr. 10, 2014, 12 pages.
Foreign communication from a related counterpart application—International Preliminary Report on Patentability, PCT/US2013/061386, dated Apr. 28, 2015, 8 pages.
Foreign communication from a related counterpart application—International Preliminary Report on Patentability, PCT/US2010/061047, dated Jul. 17, 2012, 5 pages.
Danaher product information, Motion Brakes, http://www.danahermotion.com/website/usa/eng/products/clutches_and_brakes/115836.php, Mar. 4, 2009, 3 pages, Danaher Motion.
Filing receipt and specification for provisional patent application entitled "Wellbore Servicing Tools, Systems and Methods Utilizing Near-Field Communication," by Zachary William Walton, et al., filed Mar. 12, 2013 as U.S. Appl. No. 61/778,312.
Filing receipt and specification for patent application entitled "Remotely Activated Down Hole Systems and Methods," by Frank V. Acosta, et al., filed Mar. 7, 2012 as U.S. Appl. No. 13/414,016.
Filing receipt and specification for patent application entitled "External Casing Packer and Method of Performing Cementing Job," by Lonnie Helms, et al., filed Mar. 7, 2012 as U.S. Appl. No. 13/414,140.
Filing receipt and specification for patent application entitled "Method of Completing a Multi-Zone Fracture Stimulation Treatment of a Wellbore," by Steven G. Streich, et al., filed Sep. 21, 2012 as U.S. Appl. No. 13/624,173.
Filing receipt and specification for patent application entitled "Pressure Relief-Assisted Packer," by Lonnie Carl Helms, et al., filed Oct. 25, 2012 as U.S. Appl. No. 13/660,678.
Filing receipt and specification for patent application entitled "Wellbore Servicing Tools, Systems and Methods utilizing Downhole Wireless Switches," by Michael Linley Fripp, et al., filed on May 31, 2013 as U.S. Appl. No. 13/907,593.
Filing receipt and specification for patent application entitled "Wellbore Servicing Tools, Systems and Methods utilizing Vear-Field Communication," by Zachary William Walton, et al., filed Jun. 10, 2013 as U.S. Appl. No. 13/913,881.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,004.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,114.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,177.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,216.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,238.
Filing receipt and specification for International application entitled "Pressure Equalization for Dual Seat Ball Valve," filed Mar. 8, 2013 as International application No. PCT/US2013/027666.
Filing receipt and specification for International application entitled "Autofill and Circulation Assembly and Method of Using the Same," filed Mar. 5, 2013 as International application No. PCT/US2013/027674.
Foreign communication from a related counterpart application—International Search Report and Written Opinion, PCT/US2010/061047, dated Jun. 23, 2011, 7 pages.
Foreign communication from a related counterpart application—International Search Report and Written Opinion, PCT/US2011/036686, dated Nov. 30, 2011, 8 pages.
Foreign communication from a related counterpart application—International Search Report and Written Opinion, PCT/US2012/050762, dated Mar. 11, 2013, 12 pages.
Halliburton brochure entitled "Armada™ Sampling System," Sep. 2007, 2 pages.
Halliburton Drawing 672.03800, May 4, 1994, p. 1 of 2.
Halliburton Drawing 626.02100, Apr. 20, 1999, 2 pages.
Magneta Electromagnetic Clutches and Brakes catalog, Jan. 2004, 28 pages, Magneta GmbH & Co KG.
Ogura product information, "Electromagnetic Clutch/Brake," http://www.ogura-clutch.com/products.html?category=2&by=type&no=1, Mar. 4, 2009, 4 pages, Ogura Industrial Corp.
Paus, Annika , "Near Field Communication in Cell Phones," Jul. 24, 2007, pp. 1-22 plus 1 cover and 1 content pages.
Sanni, Modiu L., et al., "Reservoir Nanorobots," Saudi Aramco Journal of Technology, Spring 2008, pp. 44-52.
Ward, Matt, et al., "RFID: Frequency, standards, adoption and innovation," JISC Technology and Standards Watch, May 2006, pp. 1-36.
Filing receipt and specification for patent application entitled "Dual Magnetic Sensor Actuation Assembly," by Zachary W. Walton, et al., filed Mar. 14, 2013 as U.S. Appl. No. 13/828,824.

(56) References Cited

OTHER PUBLICATIONS

Foreign communication from a related counterpart application—Australian Office Action, AU Application No. 2010341610, dated Feb. 27, 2014, 5 pages.
Foreign communication from a related counterpart application—International Preliminary Report on Patentability, PCT/US2011/036686, dated Jun. 12, 2013, 5 pages.

* cited by examiner

METHOD AND APPARATUS FOR MAGNETIC PULSE SIGNATURE ACTUATION

CROSS-REFERENCE TO RELATED APPLICATIONS

This application is a divisional of U.S. patent application Ser. No. 13/781,093, which was filed on Feb. 28, 2013, all of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This disclosure relates generally to equipment utilized and operations performed in conjunction with a subterranean well and, in an example described below, more particularly provides for injection of fluid into one or more selected zones in a well, and provides for magnetic field sensing actuation of well tools. It can be beneficial in some circumstances to individually, or at least selectively, actuate one or more well tools in a well. Improvements are continuously needed in the art which may be useful in operations such as selectively injecting fluid into formation zones, selectively producing from multiple zones, actuating various types of well tools, etc.

SUMMARY

Disclosed herein is a wellbore servicing tool comprising a housing comprising one or more ports and generally defining a flow passage, an actuator disposed within the housing, a magnetic signature system (MSS) comprising a magnetic sensor in signal communication with an electronic circuit disposed within the housing and coupled to the actuator, and a sleeve slidably positioned within the housing and transitional from a first position to a second position, wherein, the sleeve is allowed to transition from the first position to the second position upon actuation of the actuator, and wherein the actuator is actuated upon recognition of a predetermined quantity of predetermined magnetic pulse signatures via the MSS.

Also disclosed herein is a wellbore servicing system comprising a tubular string disposed within a wellbore, and a first well tool incorporated with the tubular string and comprising a first housing comprising a first one or more ports and generally defining a first flow passage, a first actuator disposed within the first housing, a first magnetic signature system (MSS) comprising a first magnetic sensor and a first electronic circuit disposed within the housing and coupled to the actuator, and a first sleeve slidably positioned within the first housing and transitional from a first position to a second position, wherein, the first sleeve transitions from the first position to the second position upon actuation of the first actuator, and wherein the first actuator actuates in recognition of a predetermined quantity of predetermined magnetic pulse signatures via the first MSS.

Further disclosed herein is a wellbore servicing method comprising positioning a tubular string comprising a well tool comprising a magnetic signature system (MSS), wherein the well tool is configured to either allow a route of fluid communication between the exterior of the well tool and an axial flowbore of the well tool or to prevent the route of fluid communication between the exterior of the well tool and an axial flowbore of the well tool, introducing a magnetic device to the axial flowbore of the well tool, wherein the magnetic device transmits a magnetic signal, actuating the well tool in recognition of a predetermined magnetic signature via the MSS, wherein the well tool is reconfigured to alter the route of fluid communication between the exterior of the well tool and the axial flowbore of the well tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
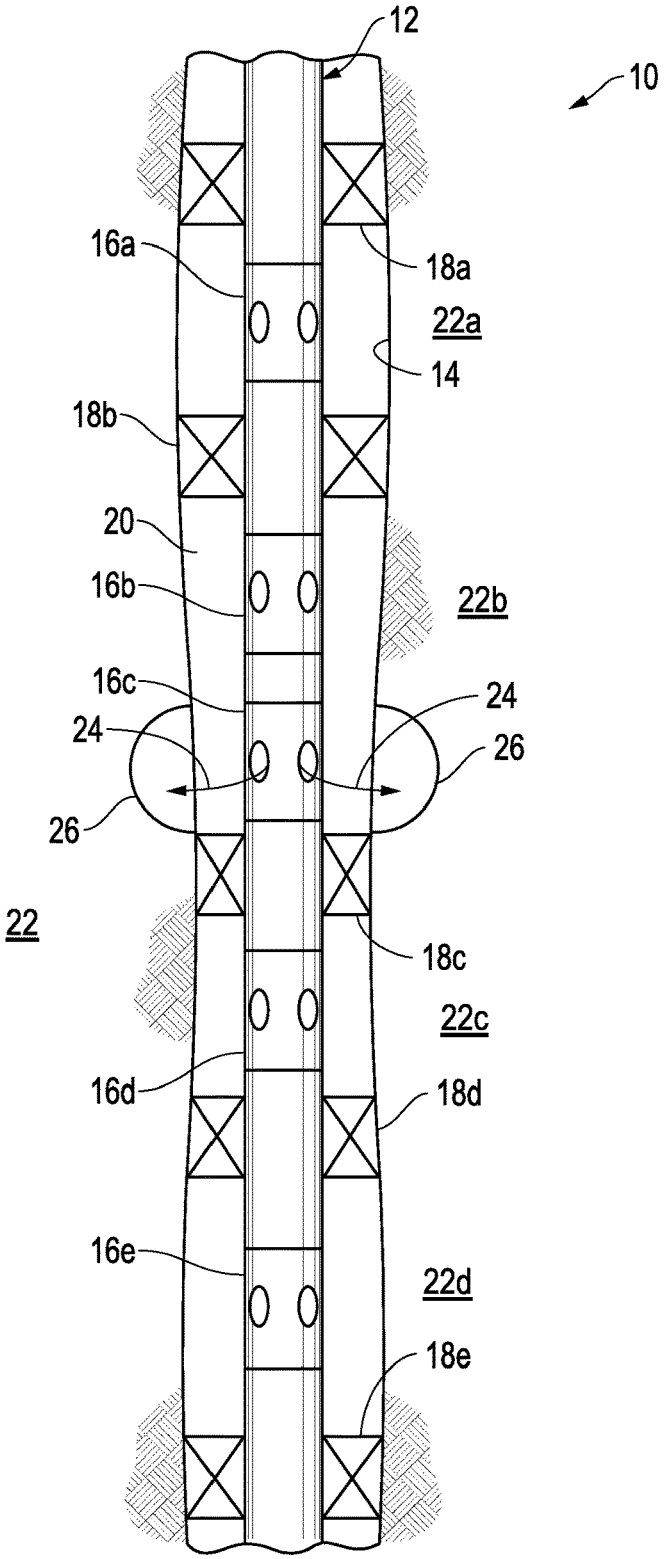
FIG. 1 is a representative partially cross-sectional view of a well system which may embody principles of this disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

In an embodiment as illustrated in FIG. 1, a wellbore servicing system 10 for use with a well and an associated method are disclosed herein. For example, in an embodiment, a tubular string 12 comprising multiple injection valves 16*a-e* and a plurality of packers 18*a-e* interconnected therein is positioned in a wellbore 14.

In an embodiment, the tubular string 12 may be of the type known to those skilled in the art such as a casing, a liner, a tubing, a production string, a work string, a drill string, a completion string, a lateral, or any type of tubular string may be used as would be appreciated by one of ordinary skill in the art upon viewing this disclosure. In an embodiment, the packers 18*a-e* may be configured to seal an annulus 20 formed radially between the tubular string 12 and the wellbore 14. In such an embodiment, the packers 18*a-e* may be configured for sealing engagement with an uncased or open hole wellbore 14. In an alternative embodiment, for example, if the wellbore is cased or lined, then cased hole-type packers may be used instead. For example, in an embodiment, swellable, inflatable, expandable and/or other types of packers may be used, as appropriate for the well conditions. In an alternative embodiment, no packers may be used, for example, the tubular string 12 could be expanded into contact with the wellbore 14, the tubular string 12 could be cemented in the wellbore, etc.

In the embodiment of FIG. 1, the injection valves 16*a-e* may be configured to selectively permit fluid communication between an interior of the tubular string 12 (e.g., a flowbore) and each section of the annulus 20 isolated between two of the packers 18*a-e*. In such an embodiment, each section of the annulus 20 is in fluid communication with one or more corresponding earth formation zones 22*a-d*. In an alternative embodiment, if the packers 18*a-e* are not used, the injection valves 16*a-e* may be placed in communication with the individual zones 22*a-d* (e.g., with perforations, etc.). In an embodiment, the zones 22*a-d* may be sections of a same formation 22 or sections of different formations. For example, in an embodiment, each zone 22*a-d* may be associated with one or more of the injection valves 16*a-e*.

In the embodiment of FIG. 1, two injection valves 16*b,c* are associated with the section of the annulus 20 isolated between the packers 18*b,c,* and this section of the annulus is in communication with the associated zone 22*b*. It will be appreciated that any number of injection valves may be associated with a zone (e.g., zones 22*a-d*).

In an embodiment, it may be beneficial to initiate fractures 26 at multiple locations in a zone (e.g., in tight shale formations, etc.), in such cases the multiple injection valves can provide for selectively communicating (e.g., injecting) fluid 24 at multiple stimulation (e.g., fracture initiation) points along the wellbore 14. For example, as illustrated in FIG. 1, the valve 16*c* has been opened and fluid 24 is being injected into the zone 22*b,* thereby forming the fractures 26. Additionally, in an embodiment, the other valves 16*a, b, d, e* are closed while the fluid 24 is being flowed out of the valve 16*c* and into the zone 22*b* thereby enabling all of the fluid 24 flow to be directed toward forming the fractures 26, with enhanced control over the operation at that particular location.

In an alternative embodiment, multiple valves 16*a-e* could be open while the fluid 24 is flowed into a zone of an earth formation 22. In the well system 10, for example, both of the valves 16*b,c* could be open while the fluid 24 is flowed into the zone 22*b* thereby enabling fractures to be formed at multiple fracture initiation locations corresponding to the open valves. In an embodiment, one or more of the valves 16*a-e* may be configured to operate at different times. For example, in an embodiment, one set (such as valves 16*b,c*) may be opened at one time and another set (such as valve 16*a*) could be opened at another time. In an alternative embodiment, one or more sets of the valves 16*a-e* may be opened substantially simultaneously. Additionally, in an embodiment, it may be preferable for only one set of the valves 16*a-e* to be open at a time, so that the fluid 24 flow can be concentrated on a particular zone, and so flow into that zone can be individually controlled.

It is noted that the wellbore servicing system 10 and method is described here and depicted in the drawings as merely one example of a wide variety of possible systems and methods which can incorporate the principles of this disclosure. Therefore, it should be understood that those principles are not limited in any manner to the details of the wellbore servicing system 10 or associated method, or to the details of any of the components thereof (for example, the tubular string 12, the wellbore 14, the valves 16*a-e*, the packers 18*a-e*, etc.). For example, it is not necessary for the wellbore 14 to be vertical as depicted in FIG. 1, for the wellbore to be uncased, for there to be five each of the valves 16*a-e* and packers 18*a-e*, for there to be four of the zones 22*a-d*, for fractures 26 to be formed in the zones, for the fluid 24 to be injected, for the treatment of zones to progress in any particular order, etc. In an embodiment, the fluid 24 may be any type of fluid which is injected into an earth formation, for example, for stimulation, conformance, acidizing, fracturing, water-flooding, steam-flooding, treatment, gravel packing, cementing, or any other purpose as would be appreciated by one of ordinary skill in the art upon viewing this disclosure. Thus, it will be appreciated that the principles of this disclosure are applicable to many different types of well systems and operations.

In an additional or alternative embodiment, the principles of this disclosure could be applied in circumstances where fluid is not only injected, but is also (or only) produced from the formation 22. In such an embodiment, the fluid 24 (e.g., oil, gas, water, etc.) may be produced from the formation 22. Thus, well tools other than injection valves can benefit from the principles described herein.

Thus, it should be understood that the scope of this disclosure is not limited to any particular positioning or arrangement of various components of the injection valve 16. Indeed, the principles of this disclosure are applicable to a large variety of different configurations, and to a large variety of different types of well tools (e.g., packers, circulation valves, tester valves, perforating equipment, completion equipment, sand screens, etc.).

Referring to FIGS. 2-6, 9, 10A-10B, 15A-15B, and 16A-16B, in an embodiment, the injection valve 16 comprises a housing 30, an actuator 50, a sleeve 32, and a magnetic signature system (MSS) 100. While embodiments of the injector valve 16 are disclosed with respect to FIGS. 2-6, 9, 10A-10B, 15A-15B, and 16A-16B, one of ordinary skill in the art, upon viewing this disclosure, will recognize suitable alternative configurations. As such, while embodiments of an injection valve 16 may be disclosed with reference to a given configuration (e.g., as will be disclosed with respect to one or more of the figures herein), this disclosure should not be construed as limited to such embodiments.

Referring to FIGS. 2, 3, 9, 10A-10B, and 15A-15B, an embodiment of the injection valve 16 is illustrated in a first configuration. In an embodiment, when the injection valve 16 is in the first configuration, also referred to as a run-in configuration/mode or installation configuration/mode, the injection valve 16 may be configured so as to disallow a route of fluid communication between the flow passage 36 of the injection valve 16 and the exterior of the injection valve 16 (e.g., the wellbore). In an embodiment, as will be disclosed herein, the injection valve 16 may be configured to transition from the first configuration to the second configuration upon experiencing a predetermined quantity of predetermined magnetic pulse signatures (e.g., at least one of one or more predetermined magnetic pulse signatures that a given valve 16 is configured/programmed to identify).

Referring to FIGS. 4-6 and 16A-16B, the injection valve 16 is illustrated in a second configuration. In an embodiment, when the injection valve 16 is in the second configuration, the injection valve 16 may be configured so as to allow a route of fluid communication between the flow passage 36 of the injection valve 16 and the exterior of the injection valve 16 (e.g., the wellbore). In an embodiment, the injection valve 16 may remain in the second configuration upon transitioning to the second configuration.

In an embodiment, the housing 30 may be characterized as a generally tubular body. The housing 30 may also be characterized as generally defining a longitudinal flowbore (e.g., the flow passage 36). Additionally, in an embodiment, the housing 30 may comprise one or more recesses or chambers formed by one or more interior and/or exterior portions of the housing 30, as will be disclosed herein. In an embodiment, the housing 30 may be configured for connection to and/or incorporation within a string, such as the tubular 12. For example, the housing 30 may comprise a suitable means of connection to the tubular 12. For instance, in an embodiment, the housing 30 may comprise internally and/or externally threaded surfaces as may be suitably employed in making a threaded connection to the tubular 12. In an additional or alternative embodiment, the housing 30 may further comprise a suitable connection interface for making a connection with a down-hole portion of the tubular 12. Alternatively, an injection valve like injection valve 16 may be incorporated within a tubular like tubular 12 by any suitable connection, such as for example, one or more quick connector type connections. Suitable connections to a tubular member will be known to those of ordinary skill in the art viewing this disclosure.

In an embodiment, the housing 30 may be configured to allow one or more sleeves to be slidably positioned therein, as will be disclosed herein. Additionally, in an embodiment, the housing 30 may further comprise a plurality of ports configured to provide a route of fluid communication between the exterior of the housing 30 and the flow passage 36 of the housing 30, when so-configured, as will be disclosed herein. For example, in the embodiment of FIG. 2, the injection valve 16 comprises one or more ports or openings (e.g., openings 28) disposed about the housing 30 and providing a route of fluid communication between the flow passage 36 and the exterior of the housing 30, as will be disclosed herein.

In an embodiment, the sleeve 32 may generally comprise a cylindrical or tubular structure. In an embodiment, the sleeve 32 may be slidably fit against an interior bore surface of the housing 30 in a fluid-tight or substantially fluid-tight manner. Additionally, in an embodiment, the sleeve 32 and/or the housing 30 may further comprise one or more suitable seals (e.g., an O-ring, a T-seal, a gasket, etc.) disposed at an interface between the outer cylindrical surface of the sleeve 32 and an inner housing surface, for example, for the purpose of prohibiting and/or restricting fluid movement via such an interface.

Referring to the embodiments of FIGS. 2-6, 9, 10A, 15A, and 16A, the sleeve 32 may be slidably positioned within the housing 30. For example, the sleeve 32 may be slidably movable between various longitudinal positions with respect to the housing 30. Additionally, the relative position of the sleeve 32 may determine if the one or more ports (e.g., the openings 28) of the housing 30 are able to provide a route of fluid communication.

Referring to the embodiments of FIGS. 2, 3, 9, 10A, and 15A, when the injection valve 16 is configured in the first configuration, the sleeve 32 is in a first position with respect to the housing 30. In such an embodiment, the sleeve 32 may be releasably coupled to the housing 30, for example, via a shear pin, a snap ring, etc., for example, such that the sleeve 32 is fixed relative to the housing 30. For example, in the embodiment of FIG. 2, the sleeve 32 is releasably coupled to the housing 30 via a shear pin 34. In an additional or alternative embodiment, the sleeve 32 may remain in the first position via an application of a fluid pressure (e.g., a supportive fluid contained within a chamber within the housing 30) onto one or more portions of the sleeve 32, as will be disclosed herein.

Referring to the embodiments of FIGS. 4-6, and 16A, when the injection valve 16 is configured in the second configuration, the sleeve 32 is in a second position with respect to the housing 30. In an embodiment, when the sleeve 32 is in the second position, the injection valve 16 may be configured to provide bidirectional fluid communication between the exterior of the injection valve 16 and the flow passage 36 of the injection valve 16, for example, via the openings 28. In an embodiment, when the sleeve 32 is in the second position, the sleeve 32 may no longer be coupled to the housing 30. In an alternative embodiment, when the sleeve 32 is in the second position, the sleeve 32 may be retained in the second position (e.g., via a snap ring).

In an embodiment, the sleeve 32 may be configured so as to be selectively moved downward (e.g., down-hole). For example, in the embodiments, of FIGS. 2-6, 9, 10A, 15A, and 16A, the injection valve 16 may be configured to transition from the first configuration to the second configuration upon receipt of a predetermined quantity of predetermined magnetic pulse signatures. For example, the injection valve 16 may be configured such that communicating a predetermined number of magnetic devices, each of which transmit a predetermined magnetic pulse signature (e.g., a magnetic pulse signature recognized by that particular injection valve 16) within the flow passage 36 causes the actuator 50 to actuate, as will be disclosed herein.

In an embodiment, the sleeve 32 may further comprise a mandrel 54 comprising a retractable seat 56 and a piston 52. For example, in the embodiment of FIG. 2, the retractable seat 56 may comprise resilient collets 58 (e.g., collet fingers) and may be configured such that the resilient collets 58 may be positioned within an annular recess 60 of the housing 30. Additionally, in an embodiment, the retractable seat 56 may be configured to sealingly engage and retain an obturating member (e.g., a magnetic device, a ball, a dart, a plug, etc.). For example, in an embodiment, following the injection valve 16 experiencing the predetermined number of predetermined magnetic pulse signatures (e.g., upon movement of the mandrel 54), the resilient collets 58 may be configured to deflect radially inward (e.g., via an inclined face 62 of the recess 60) and, thereby transition the retractable seat 56 to a sealing position. In such an embodiment, the retractable seat 56 may be configured such that an engagement with an obturating member (e.g., a magnetic device, a ball, a dart, a plug, etc.) allows a pressure to be applied onto the obturating member and thereby applies a force onto the obturating member and/or the mandrel 54, for example, so as to apply a force to the sleeve 32, for example, in a down-hole direction, as will be disclosed herein. In such an embodiment, the applied force in the down-hole direction may be sufficient to shear one or more shear pins (e.g., shear pins 34) and/or to transition the sleeve 32 from the first position to the second position with respect to the housing 30.

Figure 4:
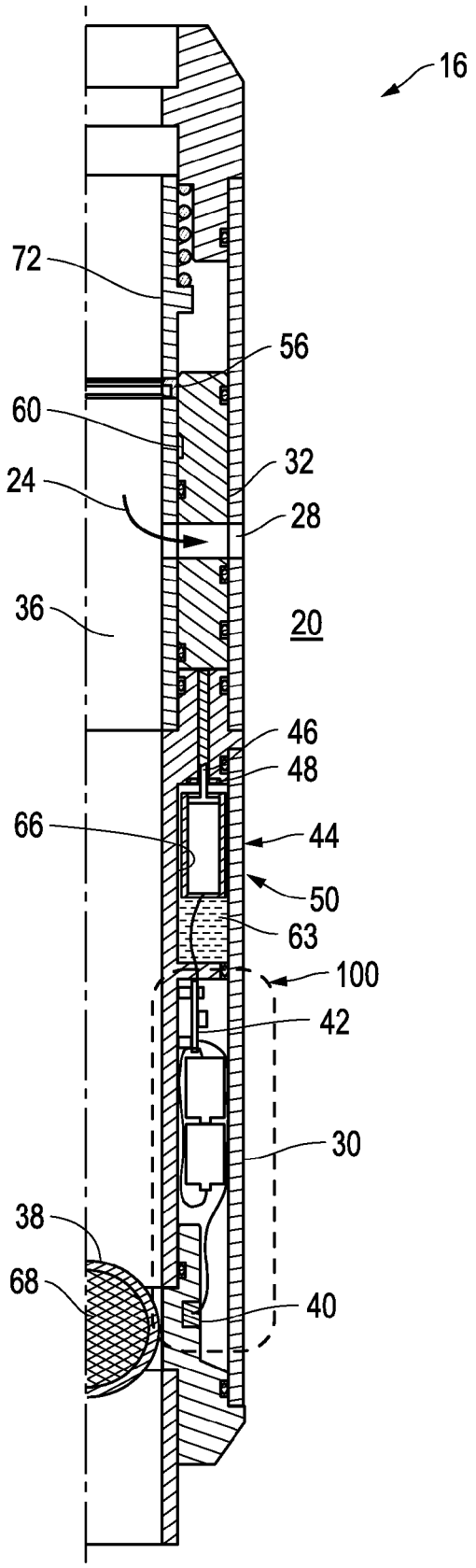
Figure 5:
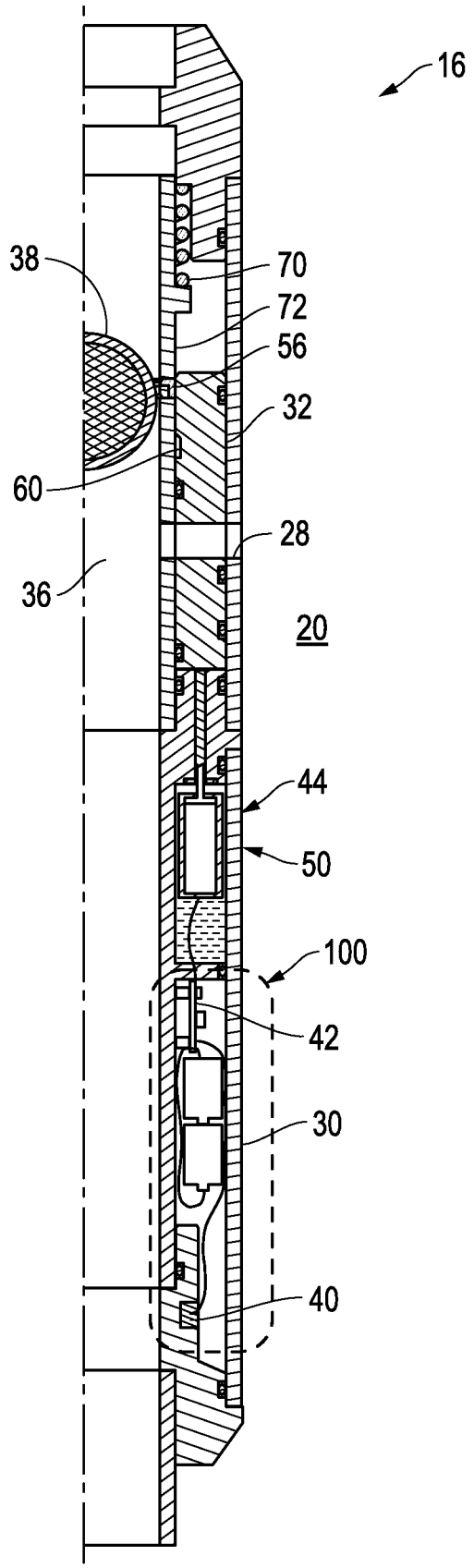
Figure 6:
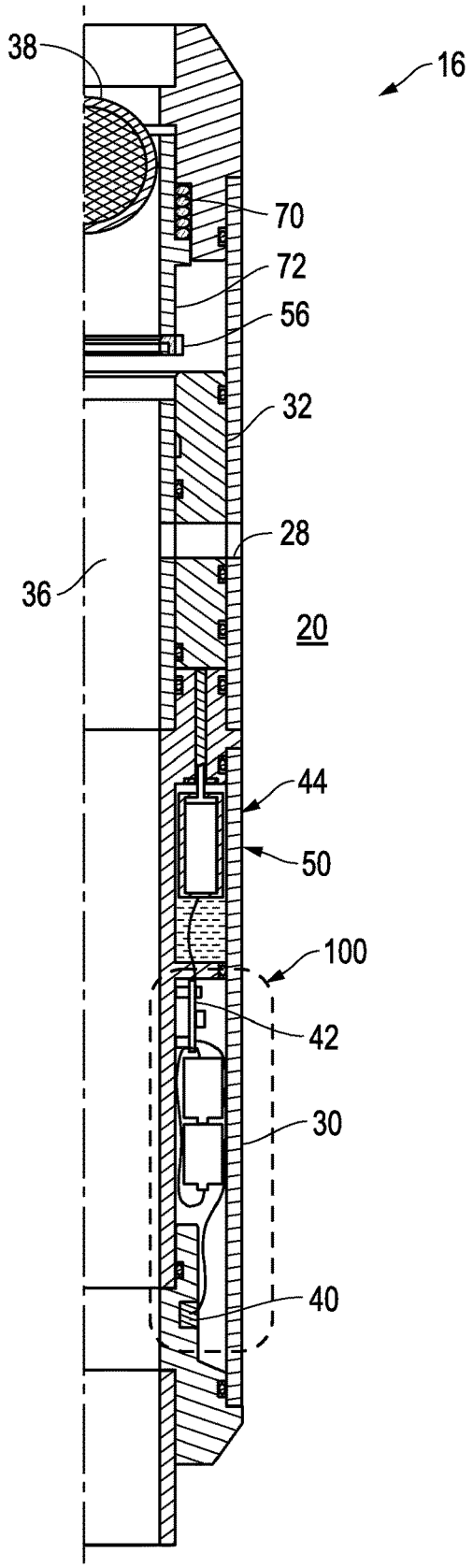

In the embodiments of FIGS. 3-6, the retractable seat 56 may be in the form of an expandable ring which may be configured to extend radially inward to its sealing position by the downward displacement of the sleeve 32, as shown in FIG. 4. Additionally, in an embodiment, the retractable seat 56 may be configured to transition to a retracted position via an application of a force onto the retractable seat 56, for example, via an upward force applied by an obturing member (e.g., a magnetic device 38). For example, in the embodiment of FIG. 5, the injection valve 16 may be configured such that when a magnetic device 38 is retrieved from the flow passage 36 (e.g., via a reverse or upward flow) of fluid through the flow passage 36) the magnetic device 38 may engage the retractable seat 56. In such an embodiment as illustrated in FIG. 6, the injection valve 16 may be further configured such that the engagement between the magnetic device 38 and the retractable seat 56 causes an upward force onto a retainer sleeve 72. For example, in such an embodiment, the upward force may be sufficient to overcome a downward biasing force (e.g., via a spring 70 applied to a retainer sleeve 72), thereby allowing the retractable seat 56 to expand radially outward and, thereby transition the retractable seat 56 to the retracted position. In such an embodiment, when the retractable seat 56 is in the retracted position, the injection valve 16 may be configured to allow the obturating member 38 to be conveyed upward in the direction of the earth's surface.

In an embodiment, the actuator 50 may comprise a piercing member 46 and/or a valve device 44. In an embodiment, the piercing member 46 may be driven by any means, such as, by an electrical, hydraulic, mechanical, explosive, chemical, or any other type of actuator as would be appreciated by one of ordinary skill in the art upon viewing this disclosure. Other types of valve devices 44 (such as those described in U.S. patent application Ser. No. 12/688,058 and/or U.S. patent application Ser. No. 12/353,664, the entire disclosures of which are incorporated herein by this reference) may be used, in keeping with the scope of this disclosure.

Figure 2:
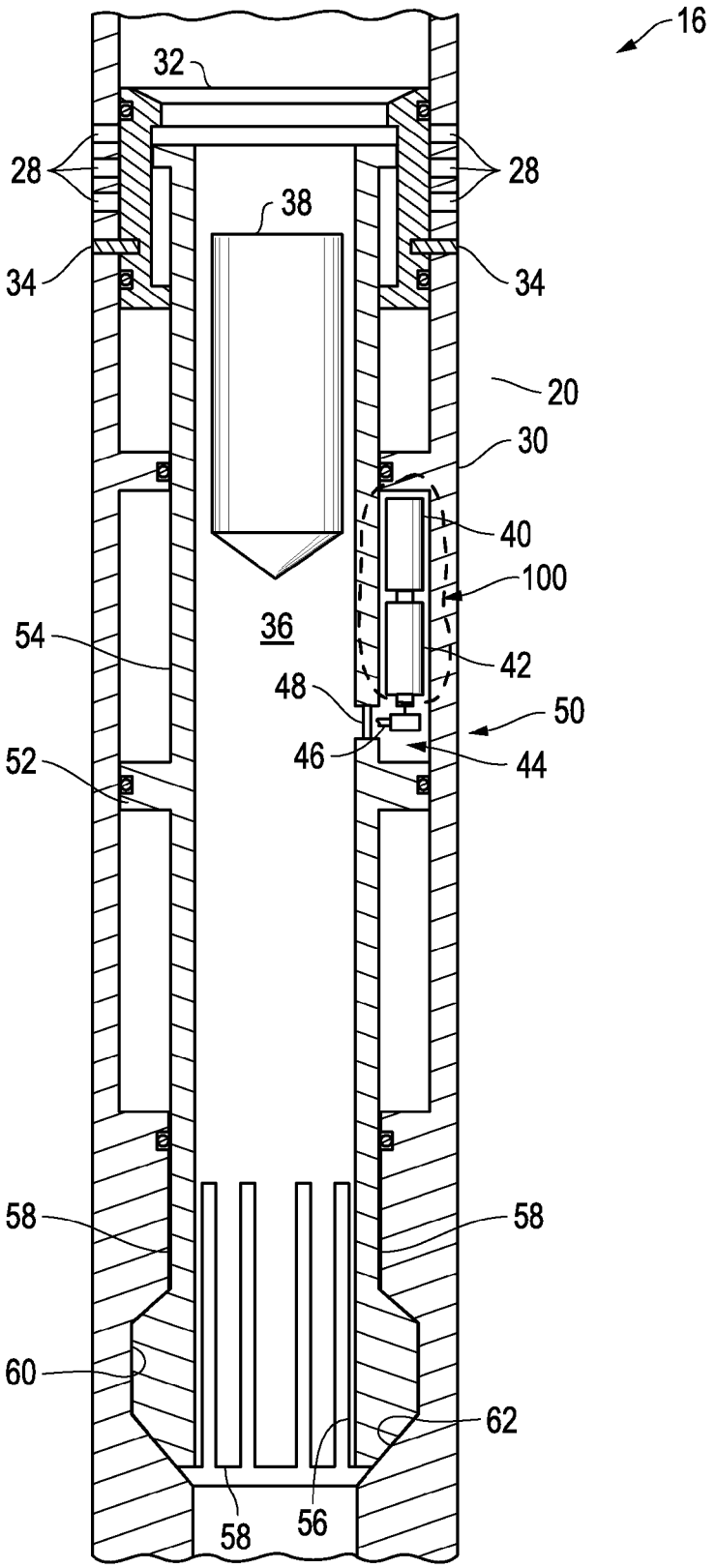
FIG. 2 is a representative partially cross-sectional view of an injection valve which may be used in the well system and/or method, and which can embody the principles of this disclosure.
Figure 3:
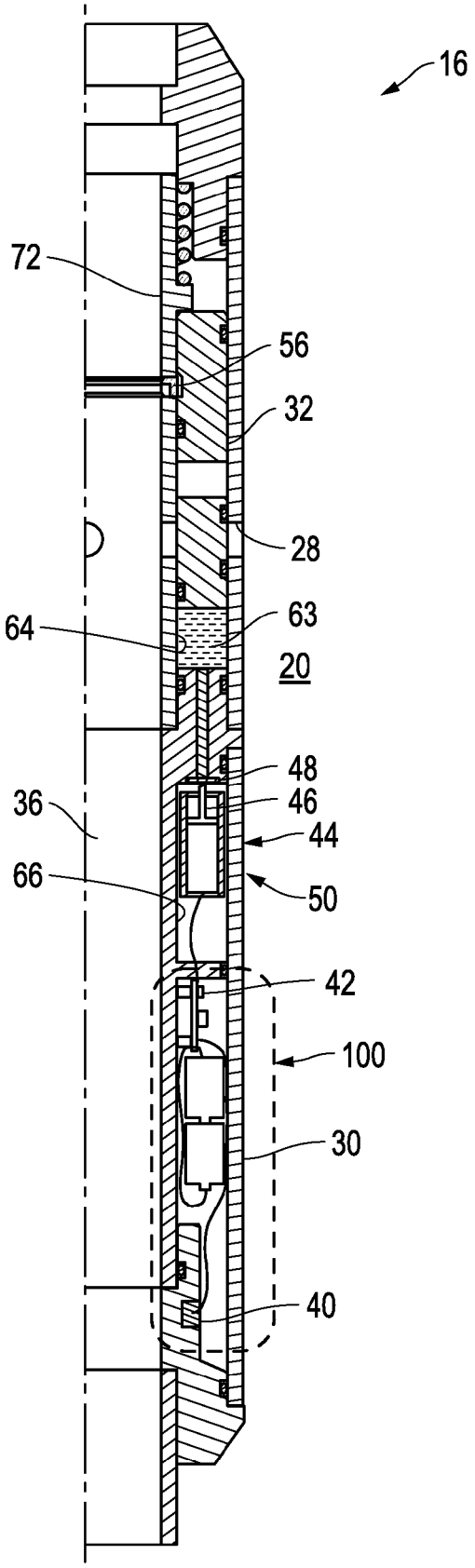
FIGS. 3-6 are a representative cross-sectional views of another example of the injection valve, in run-in, actuated and reverse flow configurations, respectively.

In an embodiment as illustrated in FIG. 2, the injector valve 16 may be configured such that when the valve device 44 is opened, a piston 52 on a mandrel 54 becomes unbalanced (e.g., via a pressure differential generated across the piston 52) and the piston 52 displaces in a down-hole direction. In such an embodiment, the pressure differential generated across the piston 52 (e.g., via an application of fluid pressure from the flow passage 36) may be sufficient to transition the sleeve 32 from the first position (e.g., a closed position) to the second position (e.g., an open position) and/or to shear one or more shear pins (e.g., shear pins 34).

Figure 9:
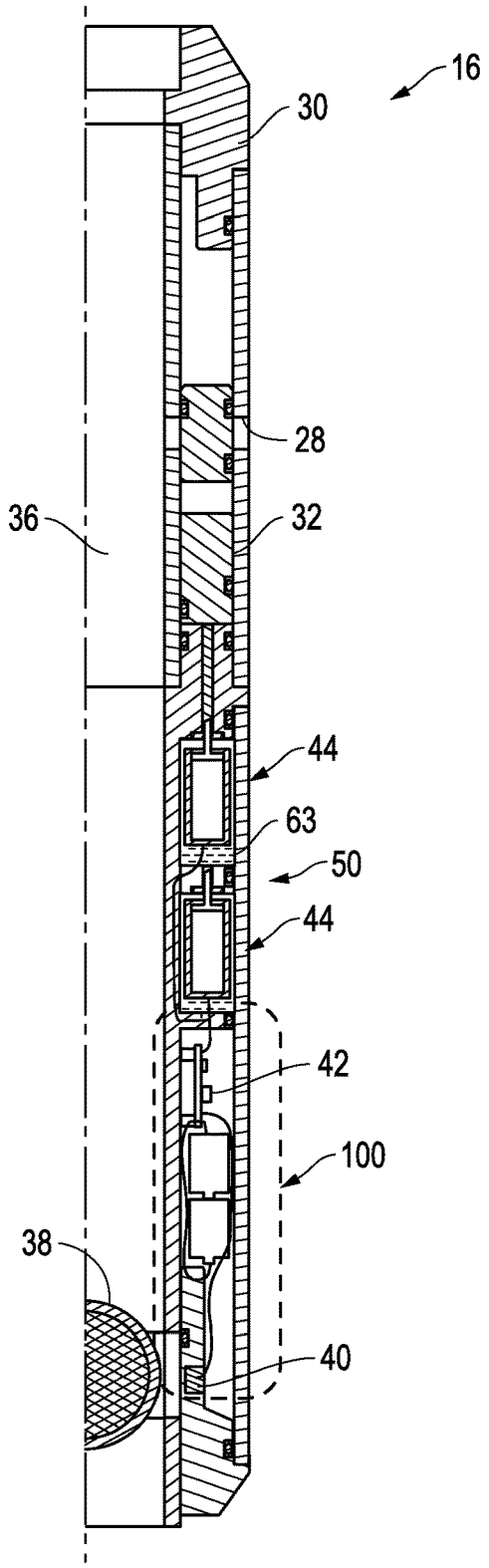
FIG. 9 is a representative cross-sectional view of another example of the injection valve.

In the embodiment shown FIG. 9, the actuator 50 may comprise two or more valve devices 44. In such an embodiment, the injection valve 16 may be configured such that when a first valve device 44 is actuated, a sufficient amount of a supportive fluid 63 is drained (e.g., allowed to pass out of a chamber, allowed to pass into a chamber, allowed to pass from a first chamber to a second chamber, or combinations thereof), thereby allowing the sleeve 32 to transition to the second position. Additionally, in an embodiment, the injection valve 16 may be further configured such that when a second valve 44 is actuated, an additional amount of supportive fluid 63 is drained, thereby allowing the sleeve 32 to be further displaced (e.g., from the second position). For example, in the embodiment of FIG. 9, displacing the sleeve 32 further may transition the sleeve 32 out of the second position thereby disallow fluid communication between the flow passage 36 of the injector valve 16 and the exterior of the injector valve 16 via the openings 28.

In an additional or alternative embodiment, the actuator 50 may be configured to actuate multiple injection valves (e.g., two or more of injection valves 16*a-e*). For example, in an embodiment, the actuator 50 may be configured to actuate multiple ones of the RAPIDFRAC™ Sleeve marketed by Halliburton Energy Services, Inc. of Houston, Tex. USA. In such an embodiment, the actuator 50 may be configured to initiate metering of a hydraulic fluid in the RAPIDFRAC™ Sleeves in response to a recognized a predetermined number of predetermined magnetic pulse signatures, for example, such that a plurality of the injection valves open after a certain period of time.

Figure 11:
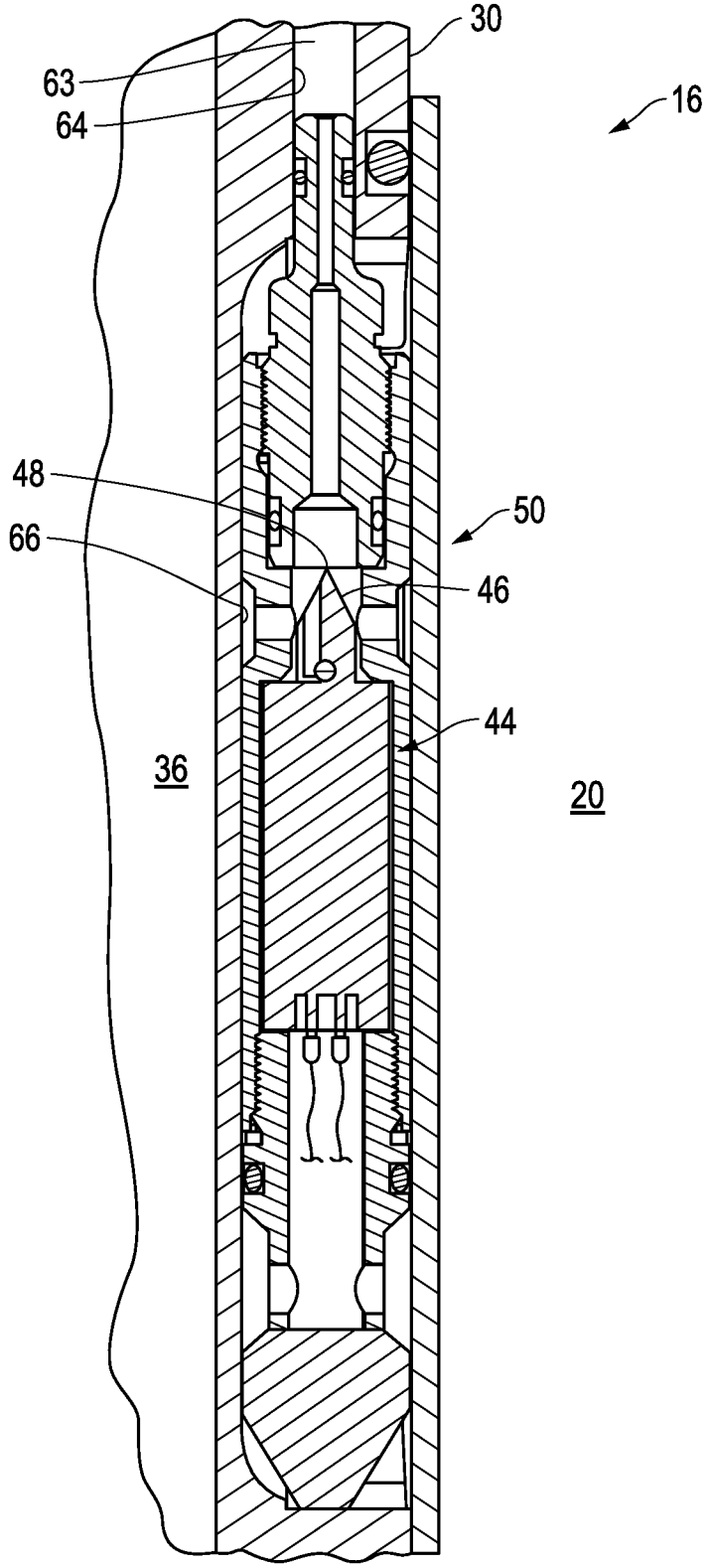
FIG. 11 is an enlarged scale representative cross-sectional view of a valve device which may be used in the injection valve.

In the embodiments of FIGS. 3-6, the injection valve 16 may further comprise one or more chambers (e.g., a chamber 64 and a chamber 66). In such embodiment, one or more of chambers may selectively retain a supportive fluid (e.g., an incompressible fluid), for example, for the purpose of retaining the sleeve 32 in the first position. For example, in the embodiment illustrated in FIG. 11, the injection valve 16 may be configured such that initially the chamber 66 contains air or an inert gas at about or near atmospheric pressure and the chamber 64 contains a supportive fluid 63. Additionally, in an embodiment, the chambers (e.g., the chamber 64 and the chamber 66) may be configured to be initially isolated from each other, for example, via a pressure barrier 48, as illustrated in FIG. 11. In an embodiment, the pressure barrier 48 may be configured to be opened and/or actuated (e.g., shattered, broken, pierced, or otherwise caused to lose structural integrity) in response to the injection valve 16 experiencing a predetermined number of predetermined magnetic pulse signatures, as will be disclosed herein. For example, in an embodiment, the actuator 50 may comprise a piercing member (e.g., piercing member 46) and may be configured to pierce the pressure barrier 48 in response to the injection valve 16 experiencing the predetermined number of predetermined magnetic pulse signatures, thereby allowing a route of fluid communication between the chambers 64 and 66.

Figure 10A:
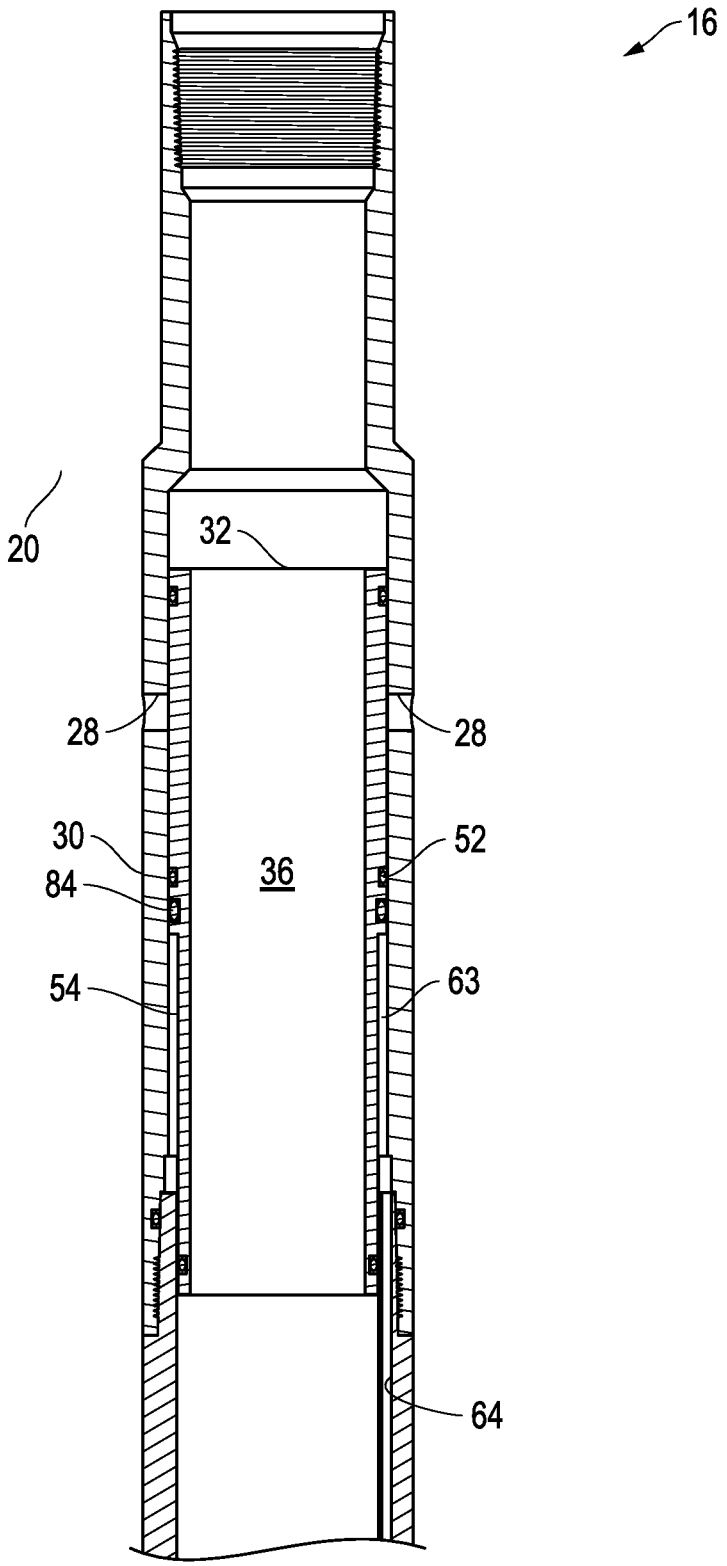
FIGS. 10A & B are representative cross-sectional views of successive axial sections of another example of the injection valve, in a closed configuration.
Figure 10B:
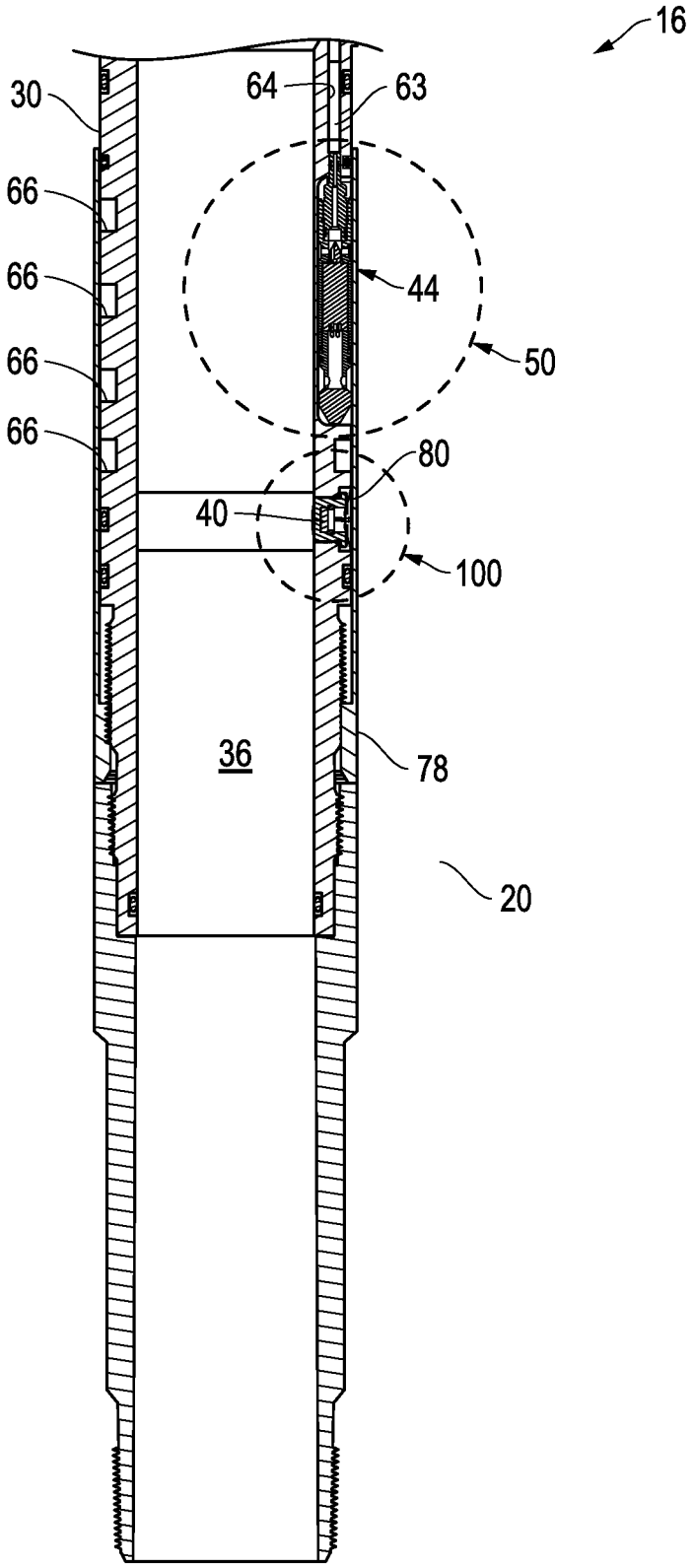

In the embodiment of FIGS. 10A-10B, the injector valve 16 may further comprise a second sleeve 78, such that the second sleeve 78 is configured to isolate the one or more chambers 66 from well fluid in the annulus 20.

In an embodiment, the injection valve 16 may be configured, as previously disclosed, so as to allow fluid to selectively be emitted therefrom, for example, in response to sensing and/or experiencing a predetermined number of predetermined magnetic signals, particularly, a predetermined number of predetermined magnetic pulse signatures as will be disclosed herein. In an embodiment, the injection valve 16 may be configured to actuate upon experiencing the predetermined number of predetermined magnetic pulse signatures, for example, as may be detected via the MSS 100, thereby providing a route of fluid communication to/from the flow passage 36 of the injection valve 16 via the ports (e.g., the openings 28).

As used herein, the term "magnetic pulse signature" refers to an identifiable and distinguishable function of one or more magnetic characteristics and/or properties (for example, with respect to time), for example, as may be experienced at one or more locations within the flow passage (such as flow passage 36) of a wellbore servicing system and/or well tool (such as the wellbore servicing system 10 and/or the injection valve 16) so as to be detected by the well tool or component thereof (e.g., by the MSS 100). As will be disclosed herein, the magnetic pulse signature may be effective to elicit a response from the well tool, such as to "wake" one or more components of the MSS 100, to actuate (and/or cause actuation of) the actuator 50 as will be disclosed herein, to increment a counter, to decrement a counter, or combinations thereof. In an embodiment, the magnetic pulse signature may be characterized as comprising any suitable type and/or configuration of magnetic field variations, for example, any suitable waveform or combination of waveforms, having any suitable characteristics or combinations of characteristics.

In an embodiment, the magnetic pulse signature may be an analog signal. For example, in an embodiment, the magnetic pulse signature may comprise a waveform (e.g., a sinusoidal wave, a square wave, a triangle wave, a saw tooth wave, a pulse width modulated wave, etc.) comprising a predetermined frequency, for example, a sinusoidal waveform having a frequency of about 12 Hertz (Hz), alternatively, about 20 Hz, alternatively, about 75 Hz, alternatively, about 100 Hz, alternatively, about 1 kilohertz (kHz), alternatively, about 10 kHz, alternatively, alternatively, about 30 kHz, alternatively, about 40 kHz, alternatively, about 50 kHz, alternatively, about 60 kHz, alternatively, any other suitable frequency as would be appreciated by one of ordinary skill in the art upon viewing this disclosure. In an alternative embodiment, the magnetic pulse signature may comprise a plurality of waveforms. For example, in an embodiment, the magnetic pulse signature may comprise a first waveform at a first frequency and a second waveform at a second frequency.

In an alternative embodiment, the magnetic pulse signature may be a digital signal, for example, a bit stream, a pulse train, a magnetic strip, etc. In such an embodiment, the magnetic pulse signature may be characterized as comprising any suitable type and/or configuration of modulation, bit rate, encryption, encoding, protocol, any other suitable digital signal characteristic as would be appreciated by one of ordinary skill in the art upon viewing this disclosure, or combination thereof. For example, in an embodiment, the magnetic pulse signature may be configured to be modulated and/or encoded via frequency modulation (FM), modified frequency modulation (MFM), run length-limited (RLL) encoding, or any other suitable modulation and/or encoding technique as would be appreciated by one of ordinary skill in the art upon viewing this disclosure. Additionally, in an embodiment, the magnetic pulse signature may be characterized as comprising a digitally encoded message or data packet. For example, in an embodiment, the magnetic pulse signature may comprise a data packet comprising an address header portion and a data portion. Additionally, in such an embodiment, the address header portion may be uniquely assigned to one or more well tools (e.g., injection valves 16) and/or the data portion may comprise individual well tool instructions (e.g., an actuation signal).

Figure 7:
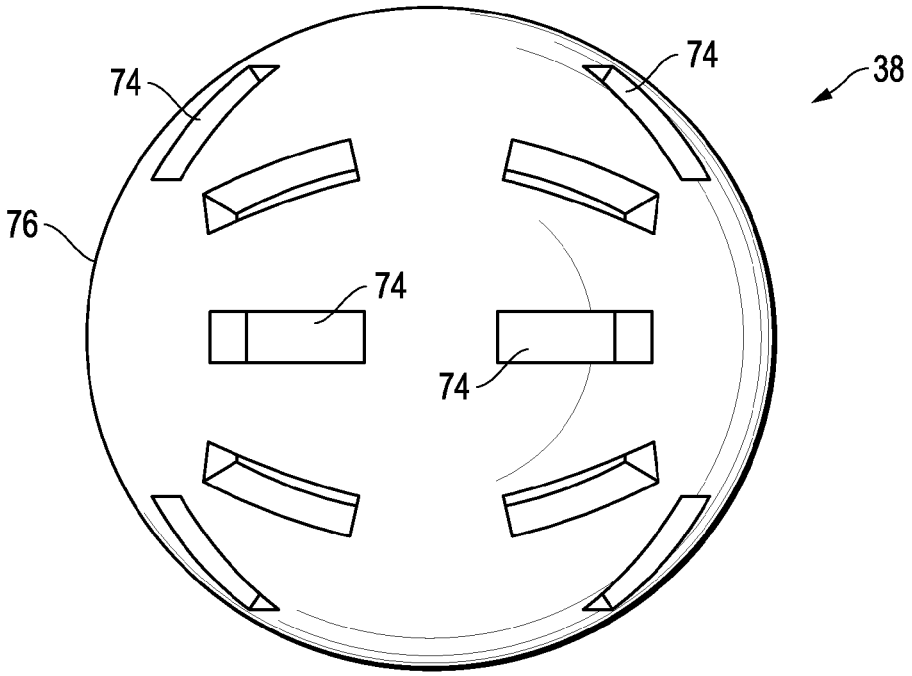
FIGS. 7 & 8 are representative top and side views, respectively, of a magnetic device which may be used with the injection valve.
Figure 8:
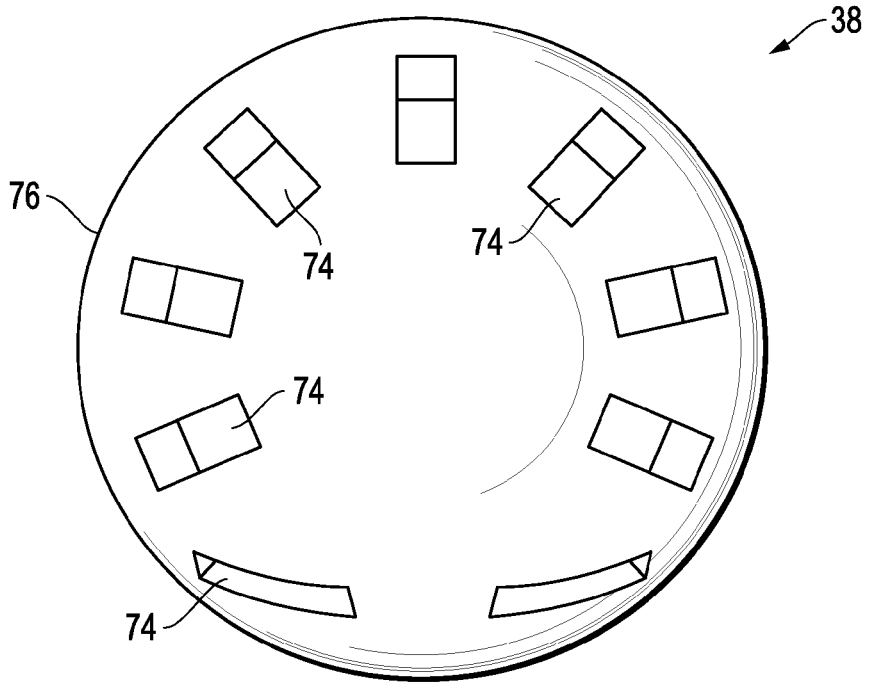

In an embodiment, the magnetic pulse signature may be generated by or formed within a well tool or other apparatus disposed within a flow passage, for example, the magnetic pulse signature may be generated by a magnetic device 38 (e.g., a ball, a dart, a bullet, a plug, etc.) which may be communicated through the flow passage 36 of the injection valve 16. For example, in the embodiments of FIGS. 7-8, the magnetic device 38 may be spherical 76 and may comprise one or more recesses 74. In the embodiments of FIGS. 15A-15B and 16A-16B, the magnetic device 38 (e.g., a ball) may be configured to be communicated/transmitted through the flow passage of the well tool and/or flow passage 36 of the injection valve 16. Also, the magnetic device 38 is configured to emit or radiate a magnetic field (which may comprise the magnetic pulse signature) so as to allow the magnetic field to interact with the injection valve 16 (e.g., the MSS 100 of one or injection valves, such as injection valve 16*a-e*), as will be disclosed herein. In an additional or alternative embodiment, the magnetic pulse signature may be generated by one or more tools coupled to a tubular, such as a work string and/or suspended within the wellbore via a wireline.

In an embodiment, the magnetic device 38 may generally comprise a permanent magnet, a direct current (DC) magnet, an electromagnet, or any combinations thereof. In an embodiment, the magnetic device 38 or a portion thereof may be made of a ferromagnetic material (e.g., a material susceptible to a magnetic field), such as, iron, cobalt, nickel, steel, rare-earth metal alloys, ceramic magnets, nickel-iron alloys, rare-earth magnets (e.g., a Neodymium magnet, a Samarium-cobalt magnet), other known materials such as Co-netic AA®, Mumetal®, Hipernon®, Hy-Mu-80®, Permalloy® (which all may comprise about 80% nickel, 15% iron, with the balance being copper, molybdenum, chromium), any other suitable material as would be appreciated by one of ordinary skill in the art upon viewing this disclosure, or combinations thereof. For example, in an embodiment, the magnetic device 38 may comprise a magnet, for example, a ceramic magnet or a rare-earth magnet (e.g., a neodymium magnet or a samarium-cobalt magnet). In such an embodiment, the magnetic device 38 may comprise a surface having a magnetic north-pole polarity and a surface having magnetic south-pole polarity and may be configured to generate a magnetic field, for example, the magnetic pulse signature.

In an additional or alternative embodiment, the magnetic device 38 may further comprise an electromagnet comprising an electronic circuit comprising a current or power source (e.g., current from one or more batteries, a power generation device, a wire line, etc.), an insulated electrical coil (e.g., an insulated copper wire with a plurality of turns arranged side-by-side), a ferromagnetic core (e.g., an iron rod), and/or any other suitable electrical or magnetic components as would be appreciated by one of ordinary skill in the arts upon viewing this disclosure, or combinations thereof. In an embodiment, the electromagnet may be configured to provide an adjustable and/or variable magnetic polarity. Additionally, in an embodiment the magnetic device 38 (which comprises the magnet and/or electromagnet) may be configured to engage one or more injection valves 16 and/or to not engage one or more other injection valves 16.

Not intending to be bound by theory, according to Ampere's Circuital Law, such an insulated electric coil may produce a temporary magnetic field while an electric current flows through it and may stop emitting the magnetic field when the current stops. Additionally, application of a direct current (DC) to the electric coil may form a magnetic field of constant polarity and reversal of the direction of the current flow may reverse the magnetic polarity of the magnetic field. In an embodiment, the magnetic device 38 may comprise an insulated electrical coil electrically connected to an electronic circuit (e.g., via a current source), thereby forming an electromagnet or a DC magnet. In an additional embodiment, the electronic circuit may be configured to provide an alternating and/or a varying current, for example, for the purpose of providing an alternating and/or varying magnetic field (e.g., the magnetic field varies with the flow of current through the electric coil). In such an embodiment, the electronic circuit may be configured to generate a pulsed magnetic signal (e.g., via the flow of an electric current through the electric coil), for example, a magnetic signal that is repeated over a given time period. Also, in an embodiment, the electronic circuit may be further configured to generate a magnetic signal comprising a modulated digital signal, a data packet, an analog waveform (e.g., a sinusoidal wave form), and/or any suitable magnetic pulse signature as would be appreciated by one of ordinary skill in the art upon viewing this disclosure. Additionally, in such an embodiment, a metal core may be disposed within the electrical coil, thereby increasing the magnetic flux (e.g., magnetic field) of the electromagnet.

Figure 15A:
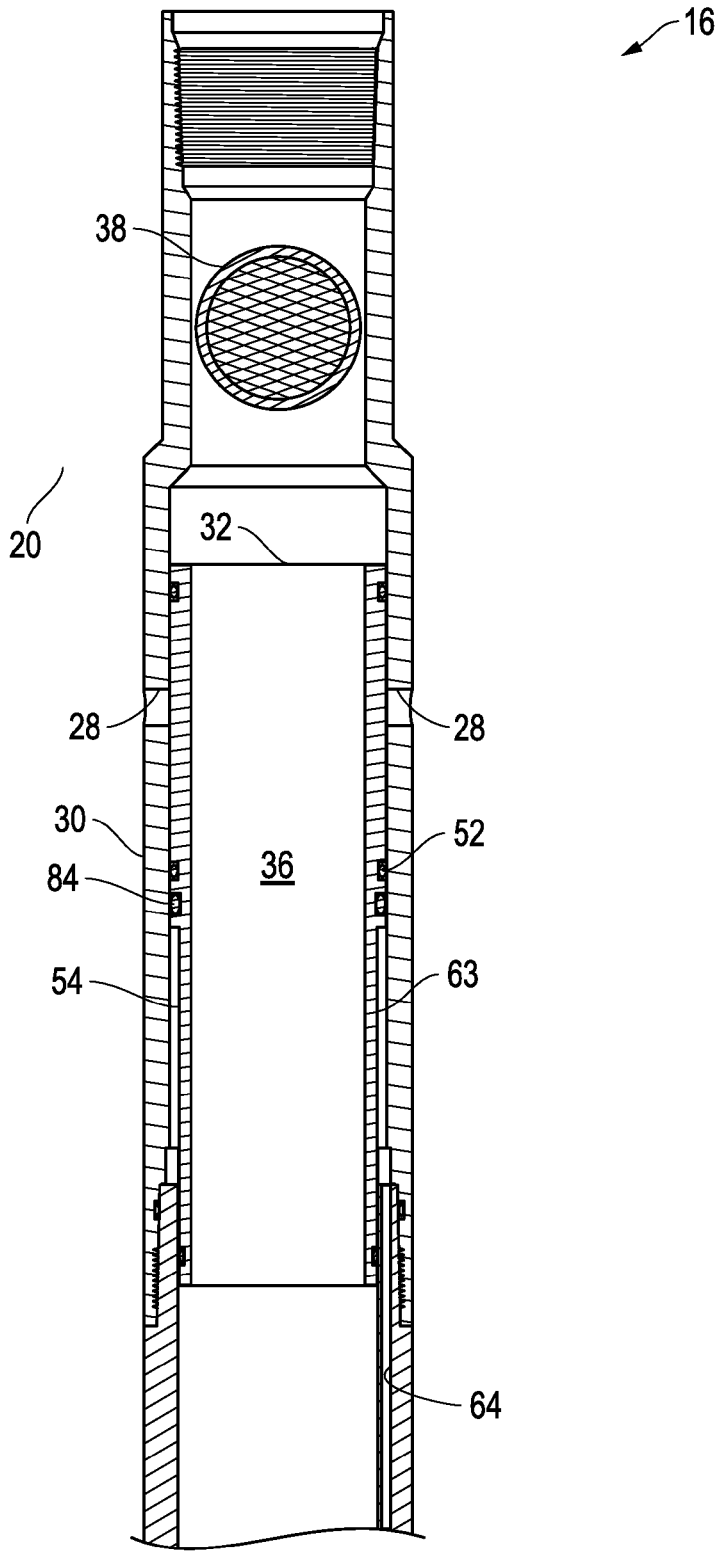
FIGS. 15A & B are representative cross-sectional views of another example of an injection valve in a first configuration.
Figure 15B:
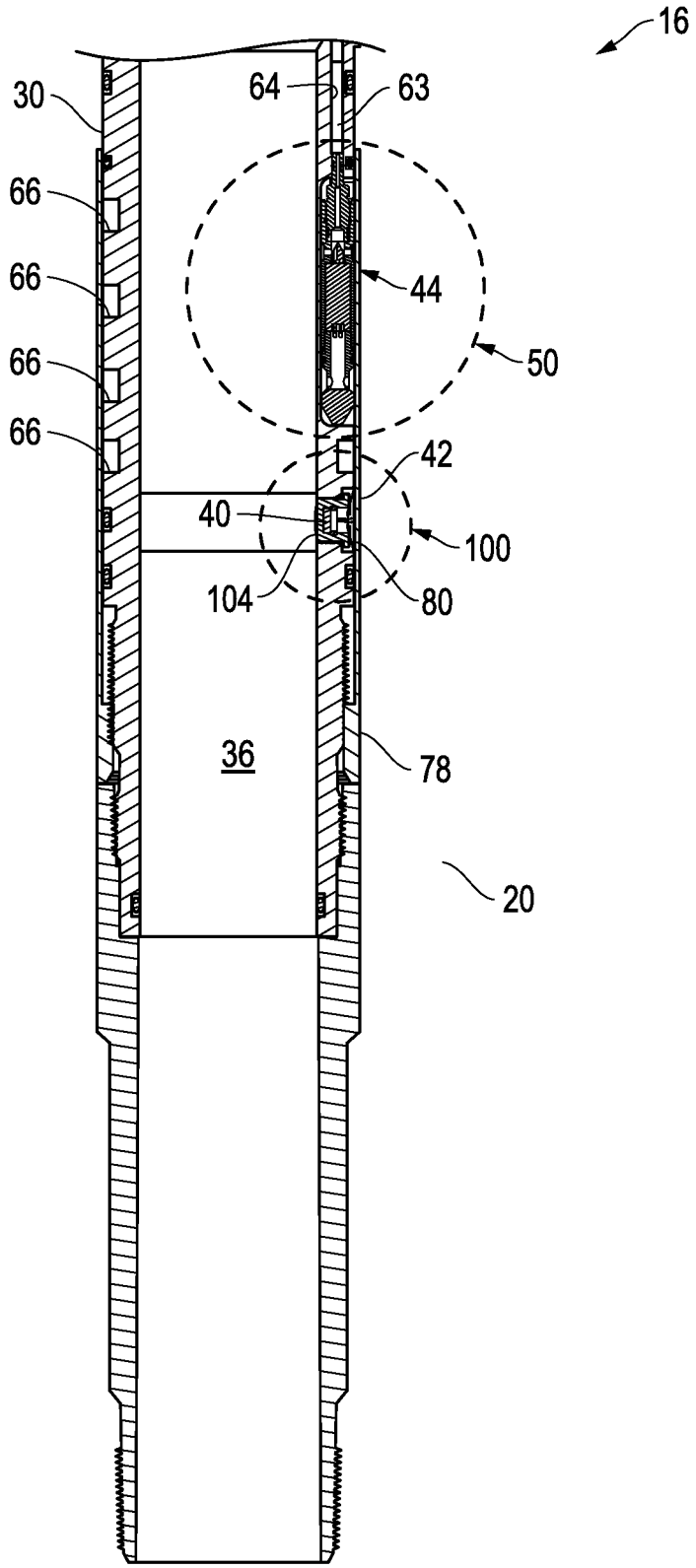
Figure 16A:
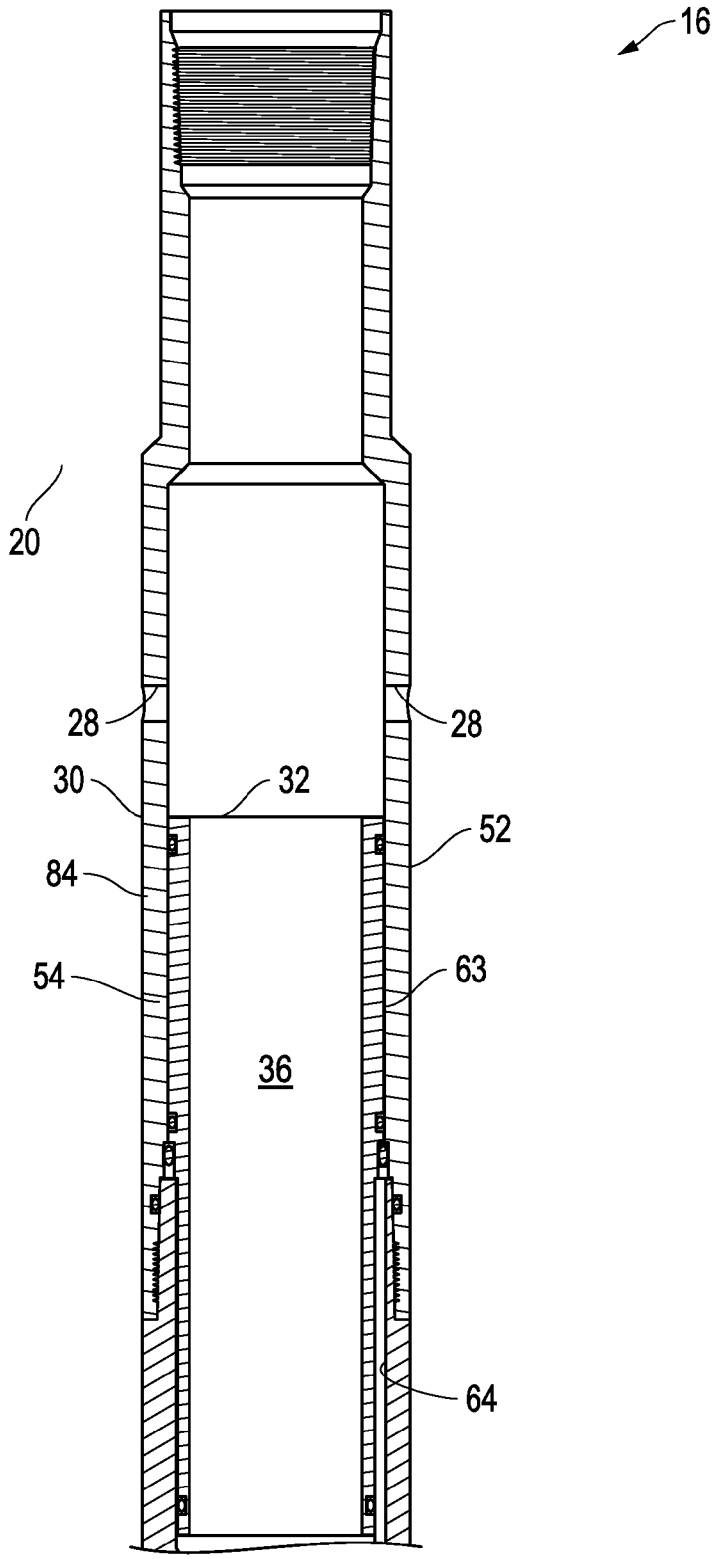
FIGS. 16A & B are representative cross-sectional views of another example of an injection valve in a second configuration.
Figure 16B:
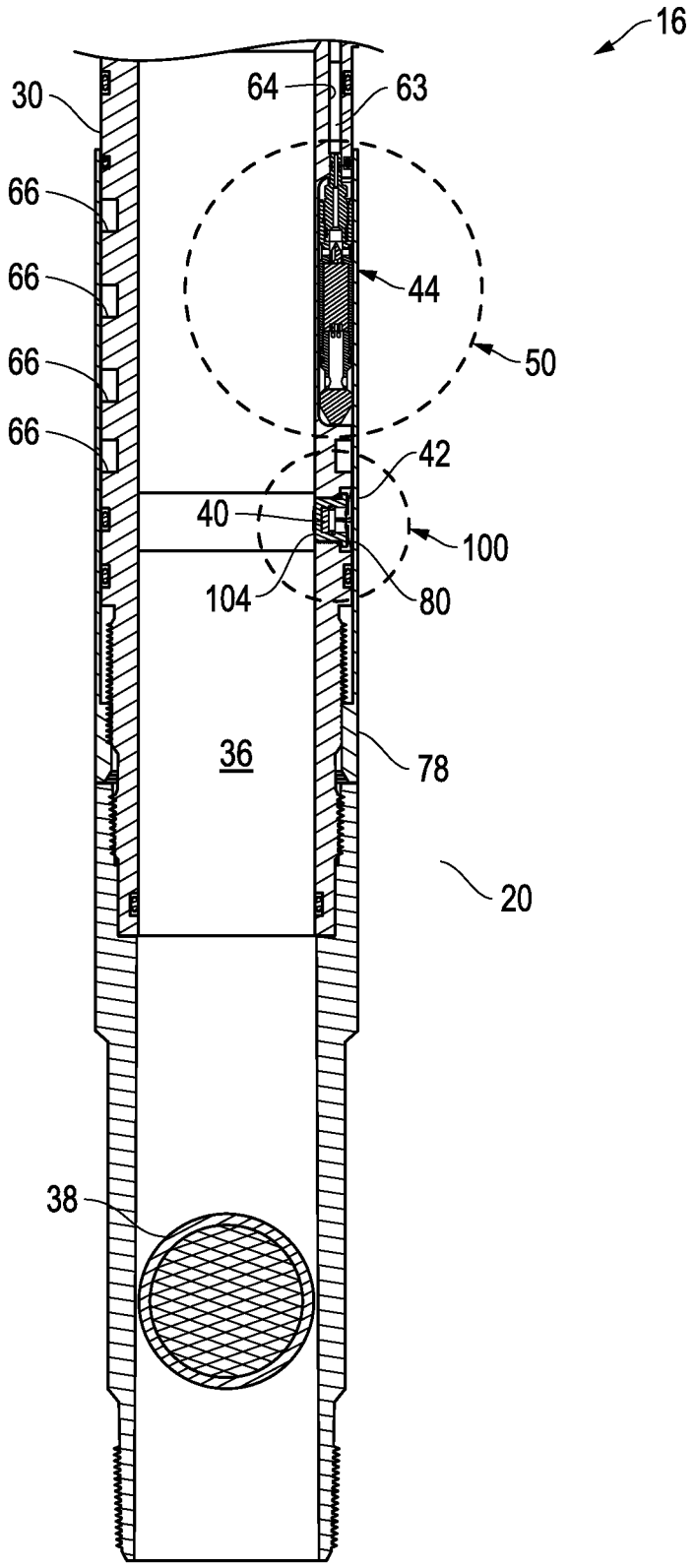

In an embodiment, the MSS 100 generally comprises a magnetic sensor 40 and an electronic circuit 42, as illustrated in FIGS. 15B and 16B. In an embodiment, the magnetic sensor 40 and/or the electronic circuit 42 may be fully or partially incorporated within the injection valve 16 by any suitable means as would be appreciated by one of ordinary skill in the art upon viewing this disclosure. For example, in an embodiment, the magnetic sensor 40 and/or the electronic circuit 42 may be housed, individually or separately, within a recess within the housing 30 of the injection valve 16. Additionally, in such an embodiment, the one or more components of the MSS 100 (e.g., the magnetic sensor 40 and/or the electronic circuit 42) may be positioned such that there is no line of sight communication (e.g., line of sight propagation) with the flow passage 36 of the injection valve 16. For example, in the embodiments of FIGS. 15B and 16B, the MSS 100 is positioned such that line of sight propagation is prohibited by a partition 104 (e.g., a conductive material, a reflective material, a layer of metal material, etc.). In an alternative embodiment, as will be appreciated by one of ordinary skill in the art, at least a portion of the magnetic sensor 40 and/or the electronic circuit 42 may be otherwise positioned, for example, external to the housing 30 of the injection valve 16. It is noted that the scope of this disclosure is not limited to any particular configuration, position, or number of magnetic sensors 40 and/or electronic circuits 42. For example, although the embodiments of FIGS. 15B and 16B illustrate a MSS 100 comprising multiple distributed components (e.g., a single magnetic sensor 40 and a single electronic circuit 42), in an alternative embodiment, a similar MSS may comprise similar components in a single, unitary component; alternatively, the functions performed by these components (e.g., the magnetic sensor 40 and the electronic circuit 42) may be distributed across any suitable number and/or configuration of like componentry, as will be appreciated by one of ordinary skill in the art upon viewing this disclosure.

In an embodiment, where the magnetic sensor 40 and the electronic circuit 42 comprise distributed components, the electronic circuit 42 may be configured to communicate with the magnetic sensor 40 and/or actuator 50 via a suitable signal conduit, for example, via one or more suitable wires. Examples of suitable wires include, but are not limited to, insulated solid core copper wires, insulated stranded copper wires, unshielded twisted pairs, fiber optic cables, coaxial cables, any other suitable wires as would be appreciated by one of ordinary skill in the art upon viewing this disclosure, or combinations thereof. Additionally, in an embodiment, the electronic circuit 42 may be configured to communicate with the magnetic sensor 40 and/or the actuator 50 via a suitable signaling protocol. Examples of such a signaling protocol include, but are not limited to, an encoded digital signal.

In an embodiment, the magnetic sensor 40 may comprise any suitable type and/or configuration of apparatus capable of detecting a magnetic field (e.g., a magnetic pulse signature) within a given, predetermined proximity of the magnetic sensor 40 (e.g., within the flow passage 36 of the injection valve 16). Suitable magnetic sensors may include, but are not limited to, a magneto-resistive sensor, a giant magneto-resistive (GMR) sensor, a microelectromechanical systems (MEMS) sensor, a Hall-effect sensor, a conductive coils sensor, a super conductive quantum interference device (SQUID) sensor, or the like. In an additional embodiment, the magnetic sensor 40 may be configured to be combined with one or more permanent magnets, for example, to create a magnetic field that may be disturbed by a magnetic device (e.g., the magnetic device 38).

In an embodiment, the magnetic sensor 40 may be configured to output a suitable indication of a detected magnetic signal, such as the magnetic pulse signature. For example, in an embodiment, the magnetic sensor 40 may be configured to convert a magnetic field to a suitable electrical signal. In an embodiment, a suitable electrical signal may comprise a varying analog voltage or current signal representative of a magnetic field and/or a variation in a magnetic field experienced by the magnetic sensor 40. In an alternative embodiment, the suitable electrical signal may comprise a digital encoded voltage signal in response to a magnetic field and/or variation in a magnetic field experienced by the magnetic sensor 40.

Figure 12:
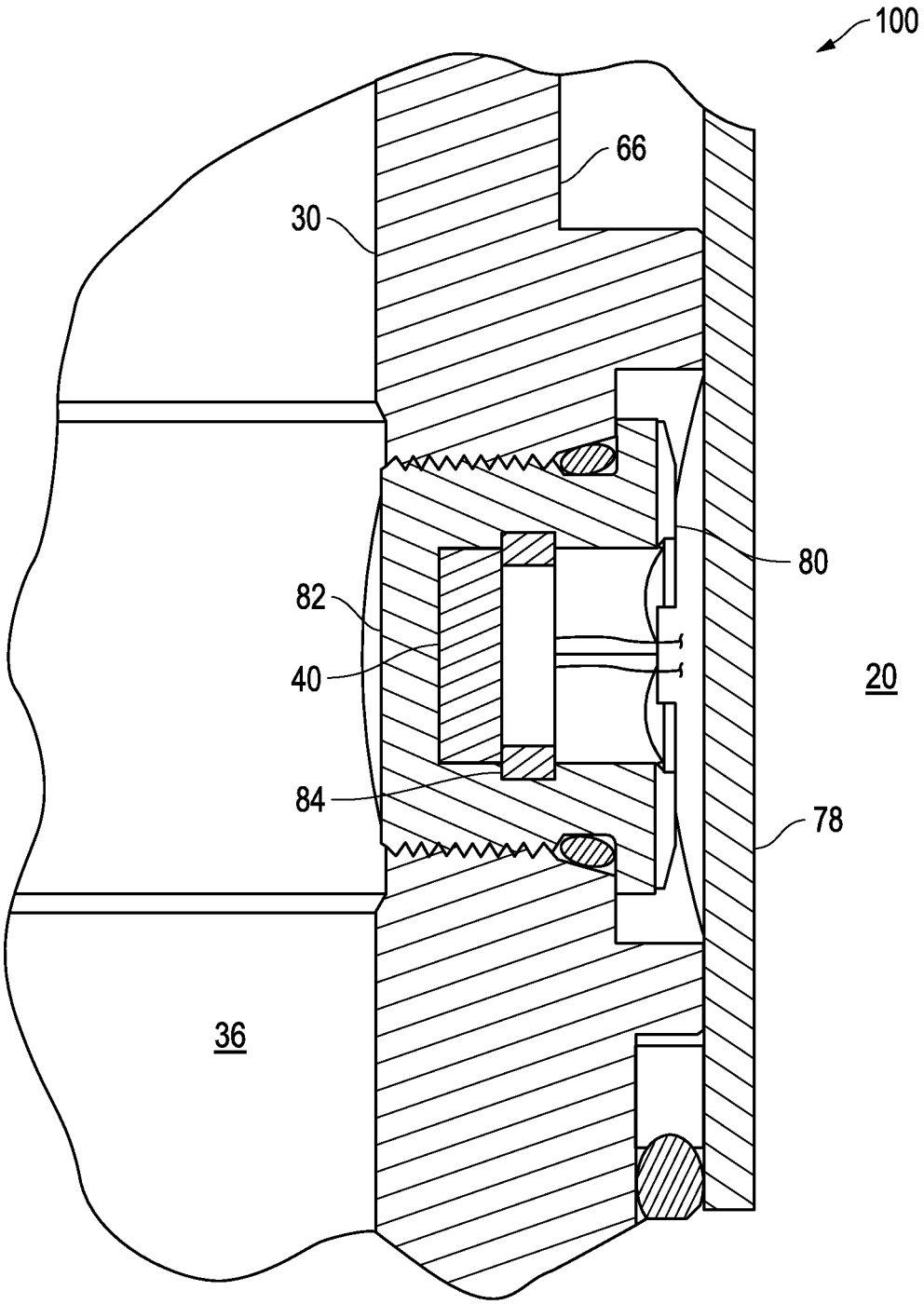
FIG. 12 is an enlarged scale representative cross-sectional view of a magnetic signature system which may be used in the injection valve.

In an embodiment, the magnetic sensor 40 may be positioned for detecting magnetic fields and/or magnetic field changes in the passage 36. For example, in the embodiment of FIG. 12, the magnetic sensor 40 is mounted in an insertable unit, such as a plug 80 which may be secured within the housing 30 in a suitably close proximity to the passage 36. In such an embodiment, the magnetic sensor 40 may be separated from the flow passage 36 by a pressure barrier 82 having a relatively low magnetic permeability (e.g., having a relatively low tendency to support the formation of a magnetic field). In an embodiment, the pressure barrier 82 may be integrally formed as part of the plug 80. In an alternative embodiment, the pressure barrier 82 could be a separate element.

Suitable low magnetic permeability materials for the pressure barrier 82 can include Inconel and other high nickel and chromium content alloys, stainless steels (such as, 300 series stainless steels, duplex stainless steels, etc.). Inconel alloys have magnetic permeabilities of about $1\times10^{-6}$, for example. Aluminum (e.g., magnetic permeability ~$1.26\times10^{-6}$), plastics, ceramics, glass, composites (e.g., with carbon fiber, etc.), and other nonmagnetic materials may also be used.

Not intending to be bound by theory, an advantage of making the pressure barrier 82 out of a low magnetic permeability material is that the housing 30 can be made of a relatively low cost high magnetic permeability material (such as steel, having a magnetic permeability of about $9\times10^{-4}$, for example), but magnetic fields produced by the magnetic device 38 in the passage 36 can be detected by the magnetic sensor 40 through the pressure barrier 82. That is, magnetic flux (e.g., the magnetic field) can readily pass through the relatively low magnetic permeability pressure barrier 82 without being significantly distorted.

In some examples, a relatively high magnetic permeability material 84 may be provided proximate the magnetic sensor 40 and/or pressure barrier 82, for example, in order to focus the magnetic flux toward the magnetic sensor 40. For example, a permanent magnet could also be used to bias the magnetic flux, for example, so that the magnetic flux is within a linear range of detection of the magnetic sensor 40.

In some examples, the relatively high magnetic permeability material 84 surrounding the magnetic sensor 40 can block or shield the magnetic sensor 40 from other magnetic fields, such as, due to magnetism in the earth surrounding the wellbore 14. For example, the material 84 allows only a focused window for magnetic fields to pass through, and only from a desired direction. Not intending to be bound by theory, this has the benefit of preventing other undesired magnetic fields from contributing to the magnetic field experienced by the magnetic sensor 40 and, thereby, the output therefrom.

Figure 13:
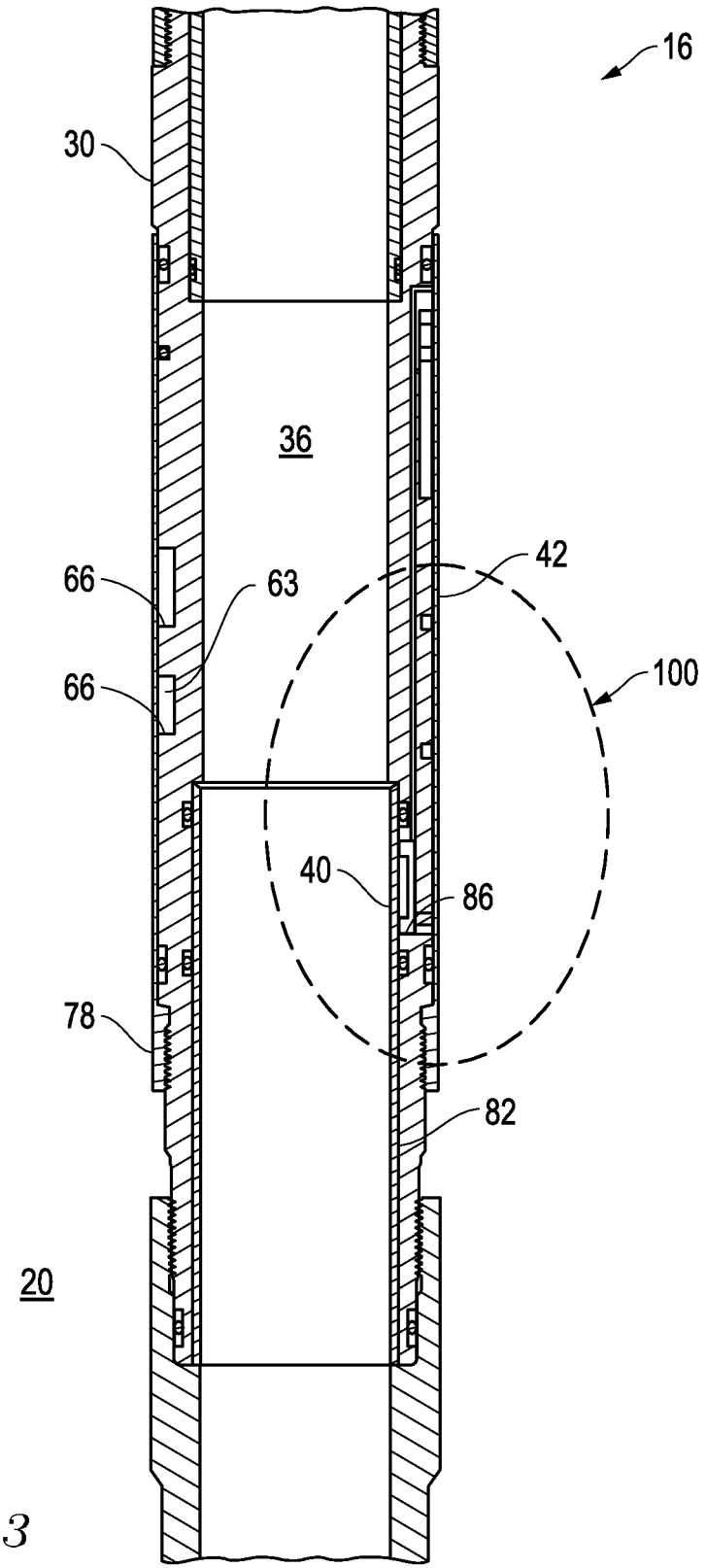
FIG. 13 is a representative cross-sectional view of another example of the injection valve.
Figure 14:
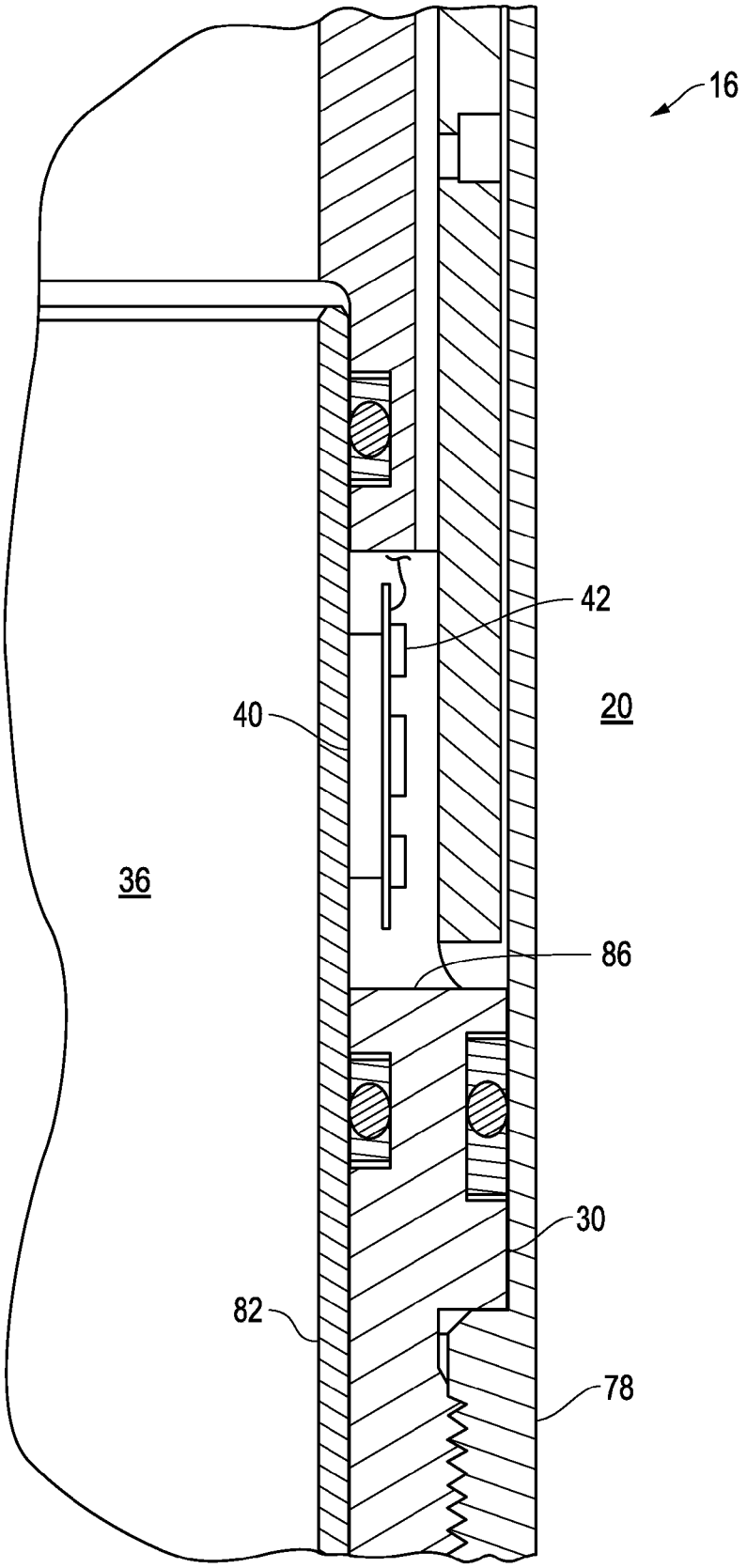
FIG. 14 is an enlarged scale representative cross-sectional view of another example of the magnetic sensor in the injection valve of FIG. 13.

Referring now to FIGS. 13 and 14, the pressure barrier 82 is in the form of a sleeve received in the housing 30. Additionally, in such an embodiment, the magnetic sensor 40 is disposed in an opening 86 formed within the housing 30, such that the magnetic sensor 40 is in close proximity to the passage 36, and is separated from the passage only by the relatively low magnetic permeability pressure barrier 82. In such an embodiment, the magnetic sensor 40 may be mounted directly to an outer cylindrical surface of the pressure barrier 82.

In the embodiment of FIG. 14, an enlarged scale view of the magnetic sensor 40 is depicted. In this example, the magnetic sensor 40 is mounted with the electronic circuitry 42 in the opening 86. For example, in such an embodiment, one or more magnetic sensors 40 may be mounted to a small circuit board with hybrid electronics thereon.

In an embodiment, the MSS 100 may comprise multiple sensors, for example, for the purpose of error checking and/or redundancy when detecting a magnetic pulse signature. In an embodiment, multiple sensors can be employed to detect the magnetic field(s) in an axial, radial or circumferential direction. Detecting the magnetic field(s) in multiple directions can increase confidence that the magnetic pulse signature will be detected regardless of orientation. Thus, it should be understood that the scope of this disclosure is not limited to any particular positioning or number of magnetic sensors 40. Additionally, in an embodiment multiple sensors (like magnetic sensor 40) may be employed to determine the direction of travel of one or more magnetic devices, for example, as disclosed in U.S. application Ser. No. 13/828,824 to Walton et al., and entitled "Dual Magnetic Sensor Actuation Assembly," which is incorporated herein in its entirety.

In an embodiment, the electronic circuit 42 may be generally configured to receive an electrical signal from the magnetic sensor 40 (e.g., which may be indicative of a magnetic signal received by the magnetic sensor 40) and to determine if variations in the electrical signal (and therefore, variations in the magnetic signal detected by the magnetic sensor 40) are indicative of a predetermined magnetic pulse signature (e.g., one of at least one predetermined magnetic pulse signature that the electronic circuit 42 is configured/programmed to identify). In an embodiment, upon a determination that the magnetic sensor 40 has experienced a magnetic signal that is a predetermined magnetic pulse signature which that particular electronic circuit has been programmed to recognize, the electronic circuit 42 may be configured to output one or more suitable responses. For example, in an embodiment, in response to recognizing a predetermined magnetic pulse signature, the electronic circuit 42 may be configured to wake (e.g., to enter an active mode), to sleep (e.g., to enter a lower power-consumption mode), to output an actuation signal to the actuator 50, or combinations thereof.

Additionally or alternatively, in an embodiment, the electronic circuit 42 may be configured to determine if the magnetic sensor 40 has experienced a predetermined number of predetermined magnetic pulse signatures. For example, in an embodiment, in response to recognizing a predetermined magnetic pulse signature, the electronic circuit 42 may be configured to record and/or count the number of predetermined magnetic pulse signatures experienced by the magnetic sensors 40. In an embodiment, the electronic circuit 42 may be configured to increment and/or decrement a counter (e.g., a digital counter, a program variable stored in a memory device, etc.) in response to experiencing a predetermined magnetic pulse signature (e.g., via a magnetic device 38) (e.g., as disclosed in U.S. application Ser. No. 13/828,824, which is incorporated herein in its entirety). In an embodiment, two or more of the predetermined magnetic pulse signatures received and recognized by the magnetic sensor 40 and the electronic circuit 42 may be the same (e.g., the magnetic pulse signatures comprise the same quantitative and/or qualitative features, as disclosed herein); alternatively, two or more of the predetermined magnetic pulse signatures received and recognized by the magnetic sensor 40 and the electronic circuit 42 may be different (e.g., the magnetic pulse signatures comprise different quantitative and/or qualitative features). In an embodiment, upon the electronic circuit 42 determining that the magnetic sensor 40 has experienced the predetermined number of predetermined magnetic pulse signatures, the electronic circuit 42 may be configured to output a suitable response, as disclosed herein. For example, in an embodiment the electronic circuit may be configured to output a suitable response upon a determination that the magnetic sensor 40 has experienced about 1, 2, 3, 4, 5, 6, 7, 8, 9, 10, 11, 12, 15, 20, 25, 30, 35, 40, or more predetermined magnetic pulse signatures.

In an embodiment, the electronic circuit 42 may be preprogrammed (e.g., prior to being disposed within the injection valve 16 and/or prior to the injection valve 16 being placed within a wellbore) to be responsive to one or more predetermined magnetic pulse signatures. In an additional or alternative embodiment, the electronic circuit 42 may be configured to be programmable (e.g., via a well tool), for example, after being disposed within the injection valve 16.

In an embodiment, the electronic circuit 42 may comprise a plurality of functional units. In an embodiment, a functional unit (e.g., an integrated circuit (IC)) may perform a single function, for example, serving as an amplifier or a buffer. The functional unit may perform multiple functions on a single chip. The functional unit may comprise a group of components (e.g., transistors, resistors, capacitors, diodes, and/or inductors) on an IC which may perform a defined function. The functional unit may comprise a specific set of inputs, a specific set of outputs, and an interface (e.g., an electrical interface, a logical interface, and/or other interfaces) with other functional units of the IC and/or with external components. In some embodiments, the functional unit may comprise repeat instances of a single function (e.g., multiple flip-flops or adders on a single chip) or may comprise two or more different types of functional units which may together provide the functional unit with its overall functionality. For example, a microprocessor or a microcontroller may comprise functional units such as an arithmetic logic unit (ALU), one or more floating-point units (FPU), one or more load or store units, one or more branch prediction units, one or more memory controllers, and other such modules. In some embodiments, the functional unit may be further subdivided into component functional units. A microprocessor or a microcontroller as a whole may be viewed as a functional unit of an IC, for example, if the microprocessor shares a circuit with at least one other functional unit (e.g., a cache memory unit).

The functional units may comprise, for example, a general purpose processor, a mathematical processor, a state machine, a digital signal processor (DSP), a receiver, a transmitter, a transceiver, a logic unit, a logic element, a multiplexer, a demultiplexer, a switching unit, a switching element an input/output (I/O) element, a peripheral controller, a bus, a bus controller, a register, a combinatorial logic element, a storage unit, a programmable logic device, a memory unit, a neural network, a sensing circuit, a control circuit, an analog to digital converter (ADC), a digital to analog converter (DAC), an oscillator, a memory, a filter, an amplifier, a mixer, a modulator, a demodulator, and/or any other suitable devices as would be appreciated by one of ordinary skill in the art.

In the embodiments of FIGS. 15A-15B and 16A-16B, the electronic circuit 42 may comprise a plurality of distributed components and/or functional units and each functional unit may communicate with one or more other functional units via a suitable signal conduit, for example, via one or more electrical connections, as will be disclosed herein. In an alternative embodiment, the electronic circuit 42 may comprise a single, unitary, or non-distributed component capable of performing the function disclosed herein.

In an embodiment, the electronic circuit 42 may be configured to sample an electrical signal (e.g., an electrical signal from the magnetic sensor 40) at a suitable rate. For example, in an embodiment, the electronic circuit 42 sample rate may be about 1 Hz, alternatively, about 4 Hz, alternatively, about 8 Hz, alternatively, about 12 Hz, alternatively, about 20 Hz, alternatively, about 100 Hz, alternatively, about 1 kHz, alternatively, about 10 kHz, alternatively, about 100 kHz, alternatively, about 1 megahertz (MHz), alternatively, any suitable sample rate as would be appreciated by one of ordinary skill in the art upon viewing this disclosure. Additionally, in an embodiment, the electronic circuit 42 may be configured to filter, amplify, demodulate, decode, decrypt, validate, error detect, error correct, perform any other suitable signal processing operation as would be appreciated by one of ordinary skill in the art upon viewing this disclosure, or combination thereof. For example, in an embodiment, the electronic circuit 42 may be configured to demodulate and validate an electrical signal received from the magnetic sensor 40, for example, for the purpose of determining if the electrical signal received from the magnetic sensor 40 is indicative of the presence of the predetermined magnetic pulse signature. Additionally, in an embodiment, the electronic circuit may be configured to recognize multiple, different magnetic pulse signature. For example, an electronic signal may be configured to determine if an electrical signal received from the magnetic sensor 40 is indicative of the presence of one of multiple predetermined magnetic pulse signatures. Further, in an embodiment, the electronic circuit 42 may be configured to record and/or count the number of predetermined magnetic pulse signatures experienced by the magnetic sensor 40.

In an embodiment, the electronic circuit 42 may be configured to output an electrical voltage or current signal to the actuator 50 in response to the presence of the predetermined magnetic pulse signature. For example, in an embodiment, the electronic circuit 42 may be configured to transition its output from a low voltage signal (e.g., about 0 volts (V)) to a high voltage signal (e.g., about 5 V) in response to experiencing the predetermined magnetic pulse signature. In an alternative embodiment, the electronic circuit 42 may be configured to transition its output from a high voltage signal (e.g., about 5 V) to a low voltage signal (e.g., about 0 V) in response to experiencing the predetermined magnetic pulse signature.

Additionally, in an embodiment, the electronic circuit 42 may be configured to operate in either a low-power consumption or "sleep" mode or, alternatively, in an operational or active mode. The electronic circuit 42 may be configured to enter the active mode (e.g., to "wake") in response to a predetermined magnetic pulse signature, for example, as disclosed herein. This method can help prevent extraneous magnetic fields from being misidentified as a magnetic pulse signature.

In an embodiment, the electronic circuit 42 may be supplied with electrical power via a power source. For example, in an embodiment, the injection valve 16 may further comprise an on-board battery, a power generation device, or combinations thereof. In such an embodiment, the power source and/or power generation device may supply power to the electronic circuit 42, to the magnetic sensor 40, to the actuator 50, or combination thereof, for example, for the purpose of operating the electronic circuit 42, to the magnetic sensor 40, to the actuator 50, or combinations thereof. In an embodiment, such a power generation device may comprise a generator, such as a turbo-generator configured to convert fluid movement into electrical power; alternatively, a thermoelectric generator, which may be configured to convert differences in temperature into electrical power. In such embodiments, such a power generation device may be carried with, attached, incorporated within or otherwise suitably coupled to the well tool and/or a component thereof. Suitable power generation devices, such as a turbo-generator and a thermoelectric generator are disclosed in U.S. Pat. No. 8,162,050 to Roddy, et al., which is incorporated herein by reference in its entirety. An example of a power source and/or a power generation device is a Galvanic Cell. In an embodiment, the power source and/or power generation device may be sufficient to power the electronic circuit 42, to the magnetic sensor 40, to the actuator 50, or combinations thereof. For example, the power source and/or power generation device may supply power in the range of from about 0.5 watts to about 10 watts, alternatively, from about 0.5 watts to about 1.0 watt.

One or more embodiments of an MSS (e.g., such as MSS 100), a well tool (e.g., such as the injection valve 16) comprising such a MSS 100, and/or a wellbore servicing system comprising a well tool (e.g., such as the injection valve 16) comprising such a MSS 100 having been disclosed, one or more embodiments of a wellbore servicing method employing such an injection valve 16, such a MSS 100, and/or such a system are also disclosed herein. In an embodiment, a wellbore servicing method may generally comprise the steps of positioning a tubular string (e.g., such as tubular string 12) having an injection valve 16 (e.g., injection valve 16*a-e*, as illustrated in FIG. 1) comprising a MSS 100 incorporated therein within a wellbore (e.g., such as wellbore 14), introducing a magnetic device 38 into the tubular string 12 and through one or more injection valves 16, and transitioning the injection valve 16 to allow fluid communication between the flow passage 36 of the injection valve 16 and the exterior of the injection valve 16 in recognition of a predetermined magnetic pulse signature (e.g., a particular magnetic pulse signature that the injection valve 16 is configured/programmed to identify).

As will be disclosed herein, the MSS 100 may control fluid communication through the tubular 12 and/or the injection valve 16 during the wellbore servicing operation. For example, as will be disclosed herein, during the step of positioning the tubular 12 within the wellbore 14, the MSS 100 may be configured to disallow fluid communication between the flow passage 36 of the injection valve 16 and the wellbore 14, for example, via not actuating the actuator 50 and thereby causing a sleeve (e.g., the sleeve 32) to be retained in the first position with respect to the housing 30, as will be disclosed herein. Also, for example, during the step of transitioning the injection valve 16 so as to allow fluid communication between the flow passage 36 of the injection valve 16 and the exterior of the injection valve 16 (e.g., upon recognition of a predetermined magnetic pulse signature) the MSS 100 may be configured to allow fluid communication between the flow passage 36 of the injection valve 16 and the exterior of the injection valve 16, for example, via actuating the actuator 50 thereby transitioning the sleeve 32 to the second position with respect to the housing 30, as will be disclosed herein.

Disclosed herein with respect to FIG. 1 is an embodiment of a wellbore servicing method employing a plurality of injection valves 16*a-e*. While the following embodiment of such a method is provided as an example of such a method, one of skill in the art, upon viewing this disclosure, will recognize various other methods and/or alterations to such method. As such, this disclosure should not be construed as limited to the methods disclosed herein.

In an embodiment, positioning the tubular 12 having one or more injection valves 16 (e.g., injection valves 16*a-e*) comprising a MSS 100 incorporated therein within a wellbore 14 may comprise forming and/or assembling components of the tubular 12, for example, as the tubular 12 is run into the wellbore 14. For example, referring to FIG. 1, a plurality of injection valves (e.g., injection valves 16*a*-16*e*), each comprising a MSS 100, are incorporated within the tubular 12 via a suitable adapter as would be appreciated by one of ordinary skill in the art upon viewing this disclosure.

In an embodiment, the tubular 12 and/or the injection valves 16*a*-16*e* may be run into the wellbore 14 to a desired depth and may be positioned proximate to one or more desired subterranean formation zones (e.g., zones 22*a*-22*d*). In an embodiment, the tubular 12 may be run into the wellbore 14 with the injection valves 16*a*-16*e* configured in the first configuration, for example, with the sleeve 32 in the first position with respect to the housing 30, as disclosed herein. In such an embodiment, with the injection valves 16*a*-16*e* in the first configuration, each valve will prohibit fluid communication between the flow passage 36 of the injection valve 16 and the exterior of the injection valve 16 (e.g., the wellbore 14). For example, as shown in FIGS. 15A-15B, when the injection valve 16 is configured in the first configuration fluid communication may be prohibited between the flow passage 36 of the injection valve 16 and the exterior of the injection valve 16 via the openings 28.

Optionally, in an embodiment, upon positioning the injection valve 16 and/or the wellbore servicing system 10, the MSS 100 may be programmed or reprogrammed to be responsive to a predetermined magnetic pulse signature. For example, in an embodiment, a second well tool (e.g., a tool on a work string, a magnetic device, etc.) may communicate with the MSS 100 to program or reprogram the MSS 100, for example, via a data packet comprising command (e.g., configuration) instructions. Alternatively, in an embodiment the MSS 100 may be programmed prior to incorporation within wellbore servicing system 10 and/or prior to placement of the wellbore servicing system 10 within the wellbore 14.

In an embodiment, one or more magnetic devices 38 may be communicated through the flow passage 36 of the injection valves 16*a-e* (e.g., via the axial flowbore of the wellbore servicing system 10) and may be pumped down-hole to magnetically actuate and, optionally, engage one or more injection valves 16*a*-16*e*. For example, in an embodiment, a magnetic device 38 may be pumped into the axial flowbore of the wellbore servicing system 10, for example, along with a fluid communicated via one or more pumps generally located at the earth's surface.

In an embodiment, the magnetic device 38 may be configured to emit and/or to transmit a magnetic pulse signature while traversing the axial flowbore of the wellbore servicing system 10. For example, in an embodiment, the magnetic device 38 may transmit a magnetic pulse signature which may be particularly and/or uniquely associated with one or more of the injection valves 16*a-e* (e.g., a signal recognized by only a certain one or more of the valves 16*a-e*, particularly, a predetermined magnetic pulse signature). In such embodiments, the magnetic device 38 may be configured to target and/or to provide selective actuation of one or more injection valves 16, thereby enabling fluid communication between the flow passage of the one or more injection valves and the exterior of the one or more injection valves. Alternatively, a magnetic device like magnetic device 38 may be configured to emit and/or transmit a magnetic signal (e.g., a magnetic pulse signature) which is not the predetermined magnetic pulse signature associated with a particular valve 16.

For example, referring to FIG. 1, the magnetic device may emit a signal (e.g., a magnetic pulse signature) which is the predetermined magnetic pulse signature associated one or more of the injection valves 16*a-e*. As an example, the magnetic device may emit a signal which is the predetermined magnetic pulse signature associated with valves 16*a*, 16*b*, 16*c*, and 16*d*, but not associated with valve 16*e*.

In an embodiment, transitioning the injection valve 16 so as to allow fluid communication between the flow passage 36 of the injection valve 16 and the exterior of the injection valve 16 in recognition of a predetermined number of predetermined magnetic pulse signatures may comprise transitioning the injection valve 16 from the first configuration to the second configuration, for example, via transitioning the sleeve 32 from the first position to the second position with respect to the housing 30, as shown in FIGS. 16A-16B. In an embodiment, the injection valve 16 and/or the MSS 100 may experience and be responsive to a predetermined magnetic pulse signature, for example, as may be emitted upon communicating one or more magnetic devices 38 through the wellbore servicing system 10 (e.g., through the injection valves 16*a*-*e*). For example, in such an embodiment, upon recognition of the magnetic pulse signature, the MSS 100 may actuate (e.g., via outputting an actuation electrical signal) the actuator 50, thereby allowing and/or causing the sleeve 32 to move relative to the housing 30 and to transition from the first position to the second position with respect to the housing 30. In an alternative embodiment, a plurality of magnetic devices are introduced to the wellbore servicing system 10 and the MSS 100 may record (e.g., within a memory device of the electronic circuit 42) and/or count (e.g., via a counter algorithm stored on the electronic circuit 42) the number of predetermined magnetic pulse signatures experienced. In such an embodiment, the MSS 100 may actuate the actuator 50 in response to experiencing a predetermined quantity (number) of predetermined magnetic pulse signatures.

Alternatively, in an embodiment, a magnetic device 38 may be communicated through a given injection valve (e.g., one of injection valve 16*a*-*e*) and may not elicit a response, for example, wherein the magnetic device emits a magnetic pulse signature that is different from a predetermined magnetic pulse signature associated with that particular injection valve.

Continuing with the example in which the magnetic device emits a signal which is the predetermined magnetic pulse signature associated with valves 16*a*, 16*b*, 16*c*, and 16*d*, upon recognition of the predetermined magnetic signature, valve 16*d* may be configured to actuate so as to allow a route of fluid communication, for example, valve 16*d* reaches the predetermined number of predetermined magnetic pulse signatures (e.g., 1 predetermined magnetic pulse signature). Also, valves 16*a*-16*c* may be configured to increment a counter associated therewith, but to not yet actuate valves 16-16*c*.

In an embodiment, when one or more injection valves 16 are configured for the communication of a servicing fluid, as disclosed herein, a suitable wellbore servicing fluid may be communicated to the subterranean formation zone associated with that valve. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation and/or a zone thereof.

In an embodiment, when a desired amount of the servicing fluid has been communicated via a first valve 16, an operator may cease the communication. Optionally, the treated zone may be isolated, for example, via a mechanical plug, sand plug, or the like, or by a ball or plug. The process of transitioning a given valve from the first configuration to the second configuration (e.g., via the introduction of various magnetic devices) and communicating a servicing through the open valve(s) 16 may be repeated with respect to one or more of the valves, and the formation zones associated therewith.

For example, continuing with the example disclosed with respect to FIG. 1, the method may further comprise communicating a second magnetic device through the tubular string 12. In an embodiment, the second magnetic device may be configured to emit a predetermined magnetic pulse signature which may be the same, alternatively different from, the predetermined magnetic pulse signature emitted by the first magnetic device. In an embodiment, upon recognition of the predetermined magnetic signature emitted by the second magnetic device valves 16*a*, 16*b*, and 16*c* may be configured to increment a counter associated therewith, thereby transitioning valve 16*a* from the first configuration to the second configuration while valves 16*b* and 16*c* remain unactuated. With valve 16*a* in the first configuration, a wellbore servicing fluid may be communicated, for example, at a rate and/or pressure sufficient to initiate and/or extend a fracture within the subterranean formation, via the valve 16*a*.

When a desired amount of the servicing fluid has been communicated via valve 16*a*, an operator may cease the communication via valve 16*a* and a third magnetic device may be communicated through the tubular string 12. In an embodiment, the third magnetic device may be configured to emit a predetermined magnetic pulse signature which may be the same, alternatively different from, the predetermined magnetic pulse signature emitted by the first magnetic device and/or the second magnetic device. In an embodiment, upon recognition of the predetermined magnetic signature emitted by the third magnetic device, valves 16*b* and 16*c* may be configured to increment a counter associated therewith, thereby transitioning valves 16*b* and 16*c* from the first configuration to the second configuration. Additionally or alternatively, in an embodiment, upon recognition of the predetermined magnetic signature emitted by the third magnetic device, valve 16*a* may be configured to transition from the second configuration to a third configuration, for example, in which the valve 16*a* will not provide a route of fluid communication to the subterranean formation. With valves 16*b* and 16*c* in the first configuration, a wellbore servicing fluid may be communicated, for example, at a rate and/or pressure sufficient to initiate and/or extend a fracture within the subterranean formation, via the valves 16*b* and 16*c*.

In an embodiment, a well tool such as the injection valve 16, a wellbore servicing system such as wellbore servicing system 10 comprising an injection valve 16 comprising a MSS, such as MSS 100, a wellbore servicing method employing such a wellbore servicing system 10 and/or such an injection valve 16 comprising a MSS 100, or combinations thereof may be advantageously employed in the performance of a wellbore servicing operation. For example, conventional wellbore servicing systems comprising a plurality of well tools (e.g., injection valves) may be limited to sequentially actuating the plurality of well tools in a toe up direction, for example, from a down-hole end of the wellbore servicing system to an up-hole end of the wellbore servicing system. In an embodiment, as previously disclosed, a MSS allows an operator to selectively actuate one or more injection valves, for example, via introducing one or more magnetic devices comprising a magnetic pulse signature uniquely associated with the one or more injection valves. As such, a MSS may be employed to provide improved performance during a wellbore operation, for example, via allowing multiple injection valves to actuate substantially simultaneously and/or to be selectively actuated in a desired sequence. Additionally, conventional well tools may be configured to actuate upon experiencing a change in a magnetic field (e.g., via a magnetic device) or a predetermined number of changes in a magnetic field (e.g., via a plurality of magnetic devices). In such conventional embodiments, the magnetic device may not comprise a magnetic pulse signature and conventional well tools may be prone to false positive readings. In an embodiment, a MSS may reduce accidental actuation (or failures to actuate) of an injection valve, for example, as a result of a false positive sensing of a magnetic device and thereby provides improved reliability of the wellbore servicing system and/or well tool.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

ADDITIONAL DISCLOSURE

The following are nonlimiting, specific embodiments in accordance with the present disclosure:

A first embodiment, which is a wellbore servicing tool comprising:

- a housing comprising one or more ports and generally defining a flow passage;
- an actuator disposed within the housing;
- a magnetic signature system (MSS) comprising a magnetic sensor in signal communication with an electronic circuit disposed within the housing and coupled to the actuator; and
- a sleeve slidably positioned within the housing and transitional from a first position to a second position;
  - wherein, the sleeve is allowed to transition from the first position to the second position upon actuation of the actuator, and
  - wherein the actuator is actuated upon recognition of a predetermined quantity of predetermined magnetic pulse signatures via the MSS.

A second embodiment, which is the wellbore servicing tool of the first embodiment, wherein, when the sleeve is in the first position, the sleeve is configured to prevent a route of fluid communication via the one or more ports of the housing and, when the sleeve is in the second position, the sleeve is configured to allow fluid communication via the one or more ports of the housing.

A third embodiment, which is the wellbore servicing tool of one of the first through the second embodiments, wherein, when the sleeve is in the first position, the sleeve is configured to allow a route of fluid communication via the one or more ports of the housing and, when the sleeve is in the second position, the sleeve is configured to prevent fluid communication via the one or more ports of the housing.

A fourth embodiment, which is the wellbore servicing tool of one of the first through the third embodiments, wherein the wellbore servicing tool further comprises a metal layer disposed between the axial flowbore of the housing and the magnetic sensor.

A fifth embodiment, which is the wellbore servicing tool of one of the first through the fourth embodiments, wherein the wellbore servicing tool further comprises a conductive material layer disposed between the axial flowbore of the housing and the magnetic sensor.

A sixth embodiment, which is the wellbore servicing tool of one of the first through the fifth embodiments, where in the predetermined quantity of predetermined magnetic pulse signatures comprises a single predetermined magnetic pulse signature that is unique to the well tool.

A seventh embodiment, which is the wellbore servicing tool of one of the first through the sixth embodiments, wherein the predetermined quantity of predetermined magnetic pulse signatures is one.

An eighth embodiment, which is the wellbore servicing tool of one of the first through the seventh embodiments, wherein the predetermined quantity of predetermined magnetic pulse signature comprises at least two magnetic pulse signatures.

A ninth embodiment, which is the wellbore servicing tool of one of the first through the eighth embodiments, wherein the MSS is programmable via a second well tool.

A tenth embodiment, which is the wellbore servicing tool of one of the first through the ninth embodiments, wherein the magnetic pulse signature is a digital signal.

An eleventh embodiment, which is the wellbore servicing tool of the tenth embodiment, wherein the digital signal is modulated and/or encoded via frequency modulation (FM), modified frequency modulation (MFM), run length-limited (RLL) encoding, or combinations thereof.

A twelfth embodiment, which is the wellbore servicing tool of one of the first through the eleventh embodiments, wherein the magnetic pulse signature is an analog signal comprising one or more predetermined frequencies.

A thirteenth embodiment, which is the wellbore servicing tool of the twelfth embodiment, wherein the analog signal comprises a sinusoidal waveform or a square waveform.

A fourteenth embodiment, which is a wellbore servicing system comprising:

- a tubular string disposed within a wellbore; and
- a first well tool incorporated with the tubular string and comprising:
  - a first housing comprising a first one or more ports and generally defining a first flow passage;
  - a first actuator disposed within the first housing;
  - a first magnetic signature system (MSS) comprising a first magnetic sensor and a first electronic circuit disposed within the housing and coupled to the actuator; and
  - a first sleeve slidably positioned within the first housing and transitional from a first position to a second position;
  - wherein, the first sleeve transitions from the first position to the second position upon actuation of the first actuator, and wherein the first actuator actuates in recognition of a predetermined quantity of predetermined magnetic pulse signatures via the first MSS.

A fifteenth embodiment, which is the wellbore servicing system of the fourteenth embodiment, wherein, when the first sleeve is in the first position, the first sleeve is configured to prevent a route of fluid communication via the first one or more ports of the first housing and when the first sleeve is in the second position, the first sleeve is configured to allow fluid communication via the first one or more ports of the first housing.

A sixteenth embodiment, which is the wellbore servicing system of one of the fourteenth through the fifteenth embodiments, wherein, when the first sleeve is in the first position, the first sleeve is configured to allow a route of fluid communication via the first one or more ports of the first housing and when the first sleeve is in the second position, the first sleeve is configured to prevent fluid communication via the first one or more ports of the first housing.

A seventeenth embodiment, which is the wellbore servicing system of one of the fourteenth through the sixteenth embodiments, wherein the first well tool further comprises a metal layer disposed between the first axial flowbore of the housing and the first magnetic sensor.

An eighteenth embodiment, which is the wellbore servicing system of one of the fourteenth through the seventeenth embodiments, where in the predetermined magnetic pulse signature is unique to the first well tool.

A nineteenth embodiment, which is the wellbore servicing system of one of the fourteenth through the eighteenth embodiments, wherein the predetermined quantity of predetermined magnetic pulse signatures is one.

A twentieth embodiment, which is the wellbore servicing tool of one of the fourteenth through the nineteenth embodiments, wherein the predetermined quantity of predetermined magnetic pulse signature is at least two.

A twenty-first embodiment, which is the wellbore servicing system of one of the fourteenth through the twentieth embodiments, wherein the first MSS is programmable via a second well tool.

A twenty-second embodiment, which is the wellbore servicing system of one of the fourteenth through the twenty-first embodiments, wherein the magnetic pulse signature comprises a digital signal.

A twenty-third embodiment, which is the wellbore servicing system of one of the fourteenth through the twenty-second embodiments, wherein the magnetic pulse signature comprises an analog signal comprising one or more predetermined frequencies.

A twenty-fourth embodiment, which is the wellbore servicing system of the twenty-third embodiment, wherein the analog signal comprises a sinusoidal waveform or a square waveform.

A twenty-fifth embodiment, which is the wellbore servicing system of one of the fourteenth through the twenty-fourth embodiments, further comprising a second well tool incorporated within the tubular string and comprising:

a housing comprising one or more ports and generally defining a flow passage;

an actuator disposed within the housing;

a MSS comprising a magnetic sensor and an electronic circuit disposed within the housing and coupled to the actuator; and a sleeve slidably positioned within the housing and transitional from a first position to a second position;

wherein, when the sleeve is in the first position , the sleeve is configured to prevent a route of fluid communication via the one or more ports of the housing and when the sleeve is in the second position, the sleeve is configured to allow fluid communication via the one or more ports of the housing, wherein, the sleeve transitions from the first position to the second position upon actuation of the actuator, and wherein the actuator actuates in recognition of a predetermined quantity of predetermined magnetic pulse signatures via the MSS.

A twenty-sixth embodiment, which is the wellbore servicing system of the twenty-fifth embodiment, further comprising a first magnetic device configured to emit a first magnetic pulse signature.

A twenty-seventh embodiment, which is the wellbore servicing system of the twenty-sixth embodiment, wherein the first magnetic pulse signature is recognized by the first well tool.

A twenty-eighth embodiment, which is the wellbore servicing system of the twenty-seventh embodiment, wherein recognition of the first magnetic pulse signature by the first well tool is effective to actuate the actuator.

A twenty-ninth embodiment, which is the wellbore servicing system of one of the twenty-seventh through the twenty-eighth embodiments, wherein recognition of the first magnetic pulse signature by the first well tool is effective to increment a counter.

A thirtieth embodiment, which is the wellbore servicing system of the twenty-seventh embodiment, wherein the first magnetic pulse signature is not recognized by the second well tool.

A thirty-first embodiment, which is the wellbore servicing system of the twenty-seventh embodiment, wherein the first magnetic pulse signature is recognized by the second well tool.

A thirty-second embodiment, which is the wellbore servicing system of the thirty-first embodiment, further comprising a second magnetic device configured to emit a second magnetic pulse signature.

A thirty-third embodiment, which is the wellbore servicing system of the thirty-second embodiment, wherein the second magnetic pulse signature is not recognized by the first well tool.

A thirty-fourth embodiment, which is the wellbore servicing system of the thirty-second embodiment, wherein the second magnetic pulse signature is recognized by the first well tool.

A thirty-fifth embodiment, which is the wellbore servicing system of the thirty-fourth embodiment, wherein recognition of the second magnetic pulse signature by the first well tool is effective to actuate the actuator.

A thirty-sixth embodiment, which is the wellbore servicing system of the thirty-fourth embodiment, wherein recognition of the first magnetic pulse signature by the first well tool is effective to increment a counter.

A thirty-seventh embodiment, which is the wellbore servicing system of the twenty-sixth embodiment, wherein the magnetic device comprises an alternating current electromagnet.

A thirty-eighth embodiment, which is the wellbore servicing system of the twenty-sixth embodiment, wherein the magnetic device comprises a direct current electromagnet.

A thirty-ninth embodiment, which is the wellbore servicing system of one of the twenty-sixth through the thirty-eighth embodiments, wherein the magnetic device comprises a direct current electromagnet and an alternating current magnet.

A fortieth embodiment, which is a wellbore servicing method comprising:

positioning a tubular string comprising a well tool comprising a magnetic signature system (MSS), wherein the well tool is configured to either allow a route of fluid communication between the exterior of the well tool and an axial flowbore of the well tool or to prevent the route of fluid communication between the exterior of the well tool and an axial flowbore of the well tool;

introducing a magnetic device to the axial flowbore of the well tool, wherein the magnetic device transmits a magnetic signal;

actuating the well tool in recognition of a predetermined magnetic signature via the MSS, wherein the well tool is reconfigured to alter the route of fluid communication between the exterior of the well tool and the axial flowbore of the well tool.

A forty-first embodiment, which is the wellbore servicing method of the fortieth embodiment, wherein actuating the tool comprises allowing fluid communication via the route of fluid communication where the fluid communication was previously prevented via the route of fluid communication.

A forty-second embodiment, which is the wellbore servicing method of one of the fortieth through the forty-first embodiments, wherein actuating the tool comprises preventing fluid communication via the route of fluid communication where the fluid communication was previously allowed via the route of fluid communication.

A forty-third embodiment, which is the wellbore servicing method of one of the fortieth through the forty-second embodiments, wherein the MSS comprises a magnetic sensor and an electronic circuit.

A forty-fourth embodiment, which is the wellbore servicing method of one of the fortieth through the forty-third embodiments, wherein the well tool further comprises a metal layer disposed between the axial flowbore of the housing and the magnetic sensor.

A forty-fifth embodiment, which is the wellbore servicing method of one of the fortieth through the forty-fourth embodiments, where in the predetermined magnetic pulse signature is unique to the well tool.

A forty-sixth embodiment, which is the wellbore servicing method of one of the fortieth through the forty fifth embodiments, wherein the predetermined magnetic pulse signature comprises a predetermined quantity of magnetic pulse signatures.

A forty-seventh embodiment, which is the wellbore servicing method of one of the fortieth through the forty-seventh embodiments, wherein the MSS is programmable via a second well tool.

A forty-eighth embodiment, which is the wellbore servicing method of one of the fortieth through the forty-seventh embodiments, wherein transitioning the well tool from the first configuration to the second configuration comprises actuating an actuator in recognition of a predetermined magnetic pulse signature.

A forty-ninth embodiment, which is the wellbore servicing method of the forty-eighth embodiment, wherein actuating the actuator transitions a sleeve from a first position to a second position.

A fiftieth embodiment, which is the wellbore servicing method of one of the fortieth through the forty-ninth embodiments, wherein the well tool is not responsive to a magnetic device transmitting a magnetic signal not comprising the predetermined magnetic pulse signature.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k* (Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing tool comprising:

a housing comprising one or more ports and generally defining a flow passage;

an actuator disposed within the housing;

a magnetic signature system comprising a magnetic sensor in signal communication with an electronic circuit disposed within the housing and coupled to the actuator, wherein the magnetic sensor detects a magnetic field within a predetermined proximity of the magnetic sensor, wherein the magnetic signature system is capable of detecting and distinguishing a modulated digital signal, a data packet, and an analog waveform, wherein the electronic circuit is configured to generate a control signal in response to detection of a predetermined magnetic pulse signature by the magnetic sensor; and a sleeve slidably positioned within the housing and transitional from a first position to a second position;

wherein the sleeve is allowed to transition from the first position to the second position upon actuation of the actuator, and wherein the actuator is actuated upon recognition of a predetermined quantity of predetermined magnetic pulse signatures via the magnetic signature system.

2. The wellbore servicing tool of claim 1, wherein, when the sleeve is in the first position, the sleeve is configured to prevent a route of fluid communication via the one or more ports of the housing and, when the sleeve is in the second position, the sleeve is configured to allow fluid communication via the one or more ports of the housing.

3. The wellbore servicing tool of claim 1, wherein, when the sleeve is in the first position, the sleeve is configured to allow a route of fluid communication via the one or more ports of the housing and, when the sleeve is in the second position, the sleeve is configured to prevent fluid communication via the one or more ports of the housing.

4. The wellbore servicing tool of claim 1, further comprises a pressure barrier disposed between the magnetic sensor and a flow passage of a wellbore.

5. The wellbore servicing tool of claim 1, wherein the wellbore servicing tool further comprises a conductive material layer disposed between the axial flowbore of the housing and the magnetic sensor.

6. The well bore servicing tool of claim 1, wherein the predetermined quantity of predetermined magnetic pulse signatures comprises a single predetermined magnetic pulse signature that is unique to the well tool.

7. The wellbore servicing tool of claim 1, wherein the predetermined quantity of predetermined magnetic pulse signatures is one.

8. The wellbore servicing tool of claim 1, wherein the predetermined quantity of predetermined magnetic pulse signature comprises at least two magnetic pulse signatures.

9. The wellbore servicing tool of claim 1, wherein the magnetic signature system is programmable via a second well tool.

10. The wellbore servicing tool of claim 1, wherein the magnetic pulse signature is a digital signal.

11. A wellbore servicing system comprising:

a tubular string disposed within a wellbore; and a first well tool incorporated with the tubular string and comprising:

a first housing comprising a first one or more ports and generally defining a first flow passage;

a first actuator disposed within the first housing;

a first magnetic signature system comprising a first magnetic sensor and a first electronic circuit disposed within the housing and coupled to the actuator , wherein the first magnetic sensor detects a magnetic field within a predetermined proximity of the first magnetic sensor, wherein the magnetic signature system is capable of detecting and distinguishing a modulated digital signal, a data packet, and an analog waveform, and wherein the first electronic circuit is configured to generate a control signal in response to detection of a predetermined magnetic pulse signature by the first magnetic sensor; and a first sleeve slidably positioned within the first housing and transitional from a first position to a second position, wherein, the first sleeve transitions from the first position to the second position upon actuation of the first actuator, and wherein the first actuator actuates in recognition of a predetermined quantity of predetermined magnetic pulse signatures via the first magnetic signature system.

12. The wellbore servicing system of claim 11, wherein, when the first sleeve is in the first position, the first sleeve is configured to prevent a route of fluid communication via the first one or more ports of the first housing and when the first sleeve is in the second position, the first sleeve is configured to allow fluid communication via the first one or more ports of the first housing.

13. The wellbore servicing system of claim 11, wherein, when the first sleeve is in the first position, the first sleeve is configured to allow a route of fluid communication via the first one or more ports of the first housing and when the first sleeve is in the second position, the first sleeve is configured to prevent fluid communication via the first one or more ports of the first housing.

14. The wellbore servicing system of claim 11, further comprising a second well tool incorporated within the tubular string and comprising:

a second housing comprising one or more ports and generally defining a flow passage;

a second actuator disposed within the second housing;

a second magnetic signature system comprising a second magnetic sensor and a second electronic circuit disposed within the second housing and coupled to the second actuator; and a second sleeve slidably positioned within the second housing and transitional from a first position to a second position;

wherein, when the sleeve is in the first position, the sleeve is configured to prevent a route of fluid communication via the one or more ports of the second housing and when the second sleeve is in the second position, the second sleeve is configured to allow fluid communication via the one or more ports of the second housing, wherein, the second sleeve transitions from the first position to the second position upon actuation of the second actuator, and wherein the second actuator actuates in recognition of a predetermined quantity of predetermined magnetic pulse signatures via the second magnetic signature system.

15. The wellbore servicing system of claim 14, further comprising a first magnetic device configured to emit a first magnetic pulse signature.

16. The wellbore servicing system of claim 15, wherein the first magnetic pulse signature is recognized by the first well tool.

17. The wellbore servicing system of claim 16, wherein recognition of the first magnetic pulse signature by the first well tool is effective to actuate the first actuator, to increment a counter, or combinations thereof.

18. The wellbore servicing system of claim 16, wherein the first magnetic pulse signature is not recognized by the second well tool.

19. The wellbore servicing system of claim 16, wherein the first magnetic pulse signature is recognized by the second well tool.

* * * * *